US008342795B2

(12) United States Patent
Hodapp

(10) Patent No.: US 8,342,795 B2
(45) Date of Patent: Jan. 1, 2013

(54) SUPPORT MEMBER FOR OPTIMIZING DYNAMIC LOAD DISTRIBUTION AND ATTENUATING VIBRATION

(75) Inventor: Thomas R. Hodapp, Dayton, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 511 days.

(21) Appl. No.: 12/428,751

(22) Filed: Apr. 23, 2009

(65) Prior Publication Data

US 2009/0269192 A1 Oct. 29, 2009

Related U.S. Application Data

(60) Provisional application No. 61/047,589, filed on Apr. 24, 2008.

(51) Int. Cl.
*F04D 1/04* (2006.01)

(52) U.S. Cl. ..... 415/55.1; 415/182.1

(58) Field of Classification Search ..... 415/119, 415/182.1
See application file for complete search history.

(56) References Cited

U.S. PATENT DOCUMENTS

| | | | | |
|---|---|---|---|---|
| 4,557,679 | A | 12/1985 | Mori et al. | |
| 4,948,346 | A | 8/1990 | Tuckey | |
| 5,042,150 | A | 8/1991 | Fraser, Jr. | |
| 5,328,340 | A | 7/1994 | Hara et al. | |
| 5,411,384 | A | 5/1995 | Bass et al. | |
| 6,247,909 | B1 | 6/2001 | Williams et al. | |
| 6,488,489 | B2 | 12/2002 | Williams et al. | |
| 6,616,429 | B1 * | 9/2003 | Weber et al. | 418/55.1 |
| 6,682,327 | B2 | 1/2004 | Milliff et al. | |
| 6,887,050 | B2 | 5/2005 | Haller | |
| 7,044,719 | B2 | 5/2006 | Yanagisawa et al. | |
| 7,063,518 | B2 | 6/2006 | Skinner et al. | |
| 7,066,723 | B2 | 6/2006 | Joo | |
| 7,163,383 | B2 | 1/2007 | Skinner | |
| 2002/0192094 | A1 | 12/2002 | Milliff et al. | |
| 2005/0002804 | A1 | 1/2005 | Yanagisawa et al. | |
| 2007/0201996 | A1 | 8/2007 | Gopinathan | |
| 2009/0185928 | A1 | 7/2009 | Bush et al. | |
| 2010/0239447 | A1 | 9/2010 | Bush | |

FOREIGN PATENT DOCUMENTS

| | | | |
|---|---|---|---|
| EP | 0154673 | A2 | 9/1985 |
| JP | 5263773 | A | 10/1993 |

OTHER PUBLICATIONS

International Search Report dated Sep. 1, 2009 regarding International Application No. PCT/US2009/041644.
Written Opinion dated Aug. 31, 2009 regarding International Application No. PCT/US2009/041644.

* cited by examiner

*Primary Examiner* — Julio J Maldonado
*Assistant Examiner* — Robert Bachner
(74) *Attorney, Agent, or Firm* — Harness, Dickey & Pierce, P.L.C.

(57) ABSTRACT

A support member for a compressor having a shell may include a hub receiving a load from the compressor, at least three spokes radially extending from the hub, and at least three attachment locations attaching the at least three spokes to the shell. The support member may further include at least one connecting portion extending between at least two of the at least three spokes to transmit a load between the at least two spokes, whereby the at least one connecting portion is spaced apart and separated from the shell.

22 Claims, 18 Drawing Sheets

SUPPORT MEMBER FOR OPTIMIZING DYNAMIC LOAD DISTRIBUTION AND ATTENUATING VIBRATION

CROSS-REFERENCE TO RELATED APPLICATIONS

This application claims the benefit of U.S. Provisional Application No. 61/047,589, filed on Apr. 24, 2008. The entire disclosure of the above application is incorporated herein by reference.

FIELD

The present disclosure relates to compressors and, more particularly, to a support member for a scroll compressor.

BACKGROUND

The statements in this section merely provide background information related to the present disclosure and may not constitute prior art.

Machines often include components that are rotatably supported by one or more support members. As these components rotate about an axis, radial forces perpendicular to the rotational axis may be generated and transmitted to the surrounding structure via the support members.

One such machine is a scroll machine, which may be used to displace various types of fluids. For example, scroll machines may be configured as an expander, a displacement engine, a pump, or a compressor. A scroll compressor generally includes an orbiting scroll member rotatably supported within the compressor by a drive shaft. When the orbiting scroll member is rotated by the drive shaft, fluid is compressed via interaction between the orbiting scroll member and a non-orbiting scroll member.

During fluid compression, forces are exerted on the orbiting scroll member and may cause the orbiting scroll member to similarly apply forces to the drive shaft. The forces applied to the drive shaft may cause the drive shaft to vibrate, which in turn, may increase the noise associated with operation of the compressor.

SUMMARY

A support member for a compressor having a shell may include a hub receiving a load from the compressor, at least three spokes radially extending from the hub, and at least three attachment locations attaching the at least three spokes to the shell. The support member may further include at least one connecting portion extending between at least two of the at least three spokes to transmit a load between the at least two spokes, whereby the at least one connecting portion is spaced apart and separated from the shell.

The at least one connecting portion may include a shape mimicking an inner surface of the shell.

The hub may include a longitudinal axis extending therethrough, whereby the longitudinal axis is substantially parallel to a longitudinal axis of the shell.

Each of the at least three spokes may be disposed in a plane that is substantially perpendicular to the longitudinal axis of the hub.

The plane may extend through an entire length of the at least three spokes.

At least three spokes may be formed at an angle relative to a hypothetical plane extending through at least a portion of the at least three spokes and substantially perpendicular to the longitudinal axis of the hub.

The at least one connecting portion may be disposed in a plane that is substantially perpendicular to the longitudinal axis of the hub.

Each of the at least three spokes may include a longitudinal axis extending along its length.

At least one of the longitudinal axes may pass through one of the at least three attachment locations.

Each one of the longitudinal axes may pass through a respective one of the at least three attachment locations.

Each one of the longitudinal axes may be spaced apart from each one of the at least three attachment locations.

A support member for a compressor including a shell may include a hub receiving a load from the compressor, four spokes radially extending from the hub, and four attachment locations attaching the four spokes to the shell. The support member may further include four connecting portions respectively extending between each pair of the four spokes to connect each spoke and transmit a load between the spokes, whereby the four connecting portions and the four spokes are disposed in the same plane.

The four connecting portions may cooperate to form a ring encircling the hub.

The ring may include a central axis that is coaxial with a rotational axis of a drive member extending through the hub.

The four connecting portions may be spaced apart and separated from the shell.

The four connecting portions may include a shape that mimics a shape of the shell.

Each of the four spokes may include a longitudinal axis extending along its length.

At least one of the longitudinal axes may pass through one of the four attachment locations.

Each one of the longitudinal axes may pass through a respective one of the four attachment locations.

Each one of the longitudinal axes may be spaced apart from each one of the four attachment locations.

A compressor may include a shell, a compression mechanism disposed within the shell, and a drive mechanism disposed within the shell for driving the compression mechanism. A support member may include a hub rotatably supporting the drive member, at least three spokes radially extending from the hub, at least three attachment locations attaching the at least three spokes to the shell, and at least one connecting portion extending between at least two of the at least three spokes to transmit a load between the at least two spokes, whereby the at least one connecting portion is spaced apart and separated from the shell.

The at least one connecting portion may include a shape mimicking an inner surface of the shell.

The hub may include a longitudinal axis extending therethrough, whereby the longitudinal axis is substantially parallel to a longitudinal axis of the drive member.

Each of the at least three spokes may be disposed in a plane that is substantially perpendicular to the longitudinal axis of the hub.

The plane may extend through an entire length of the at least three spokes.

At least three spokes may be formed at an angle relative to a hypothetical plane extending through at least a portion of the at least three spokes and substantially perpendicular to the longitudinal axis of the hub.

At least one connecting portion may be disposed in a plane that is substantially perpendicular to the longitudinal axis of said hub.

Each of the at least three spokes may include a longitudinal axis extending along its length.

At least one of the longitudinal axes may pass through one of the at least three attachment locations.

Each one of the longitudinal axes may pass through a respective one of the at least three attachment locations.

Each one of the longitudinal axes may be spaced apart from each one of the at least three attachment locations.

A compressor may include a shell, a compression mechanism disposed within the shell, and a drive mechanism disposed within the shell for driving the compression mechanism. A support member may include a hub receiving a load from the drive member, four spokes radially extending from the hub, four attachment locations attaching the four spokes to the shell, and four connecting portions respectively extending between each pair of the four spokes to connect each spoke and transmit a load between the spokes, whereby the four connecting portions and the four spokes are disposed in the same plane.

The four connecting portions may cooperate to form a ring encircling the hub.

The ring may include a central axis that is coaxial with a rotational axis of a drive member extending through the hub.

The four connecting portions may be spaced apart and separated from the shell.

The four connecting portions may include a shape that mimics a shape of the shell.

Each of the four spokes may include a longitudinal axis extending along its length.

At least one of the longitudinal axes may pass through one of the four attachment locations.

Each one of the longitudinal axes may pass through a respective one of the four attachment locations.

Each one of the longitudinal axes may be spaced apart from each one of the four attachment locations.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 1:
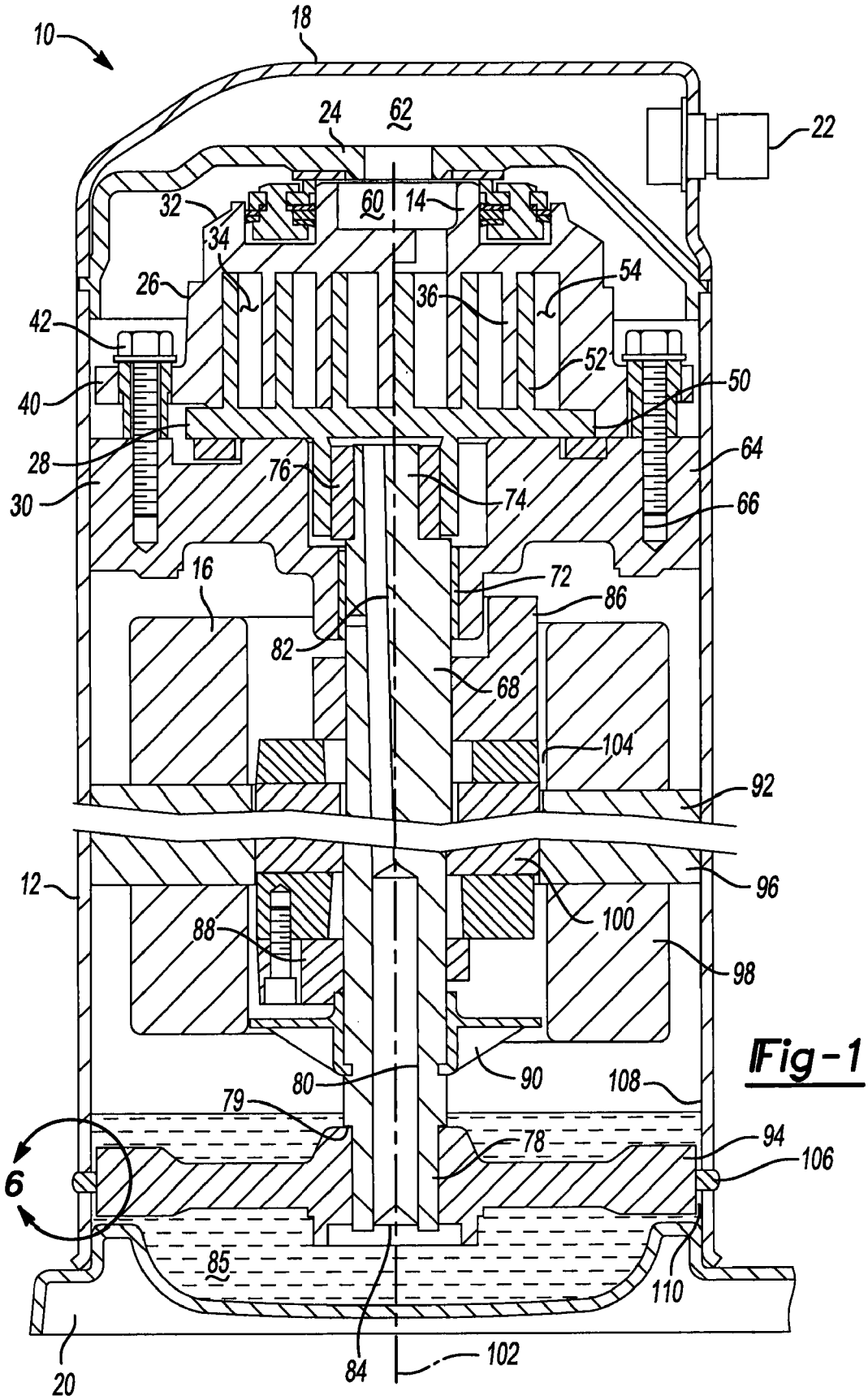
FIG. 1 is a cross-sectional view of a scroll machine that includes a support member according to the principles of the present disclosure.
Figure 3A:
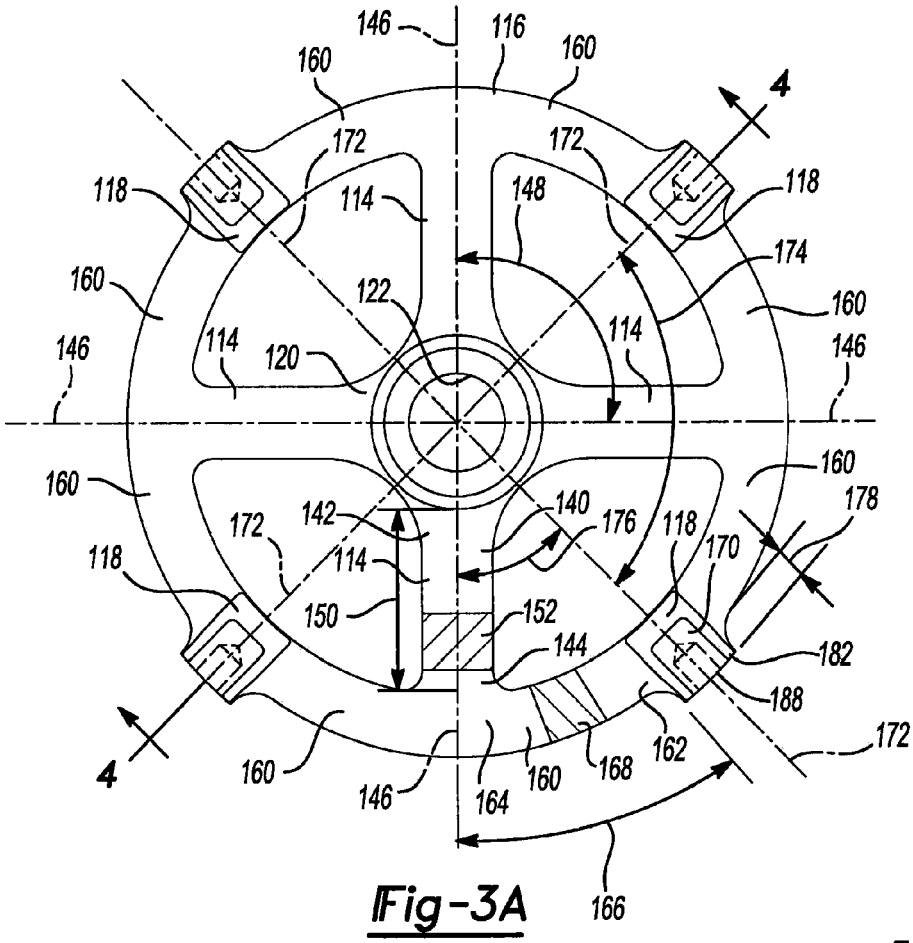
Figure 4:
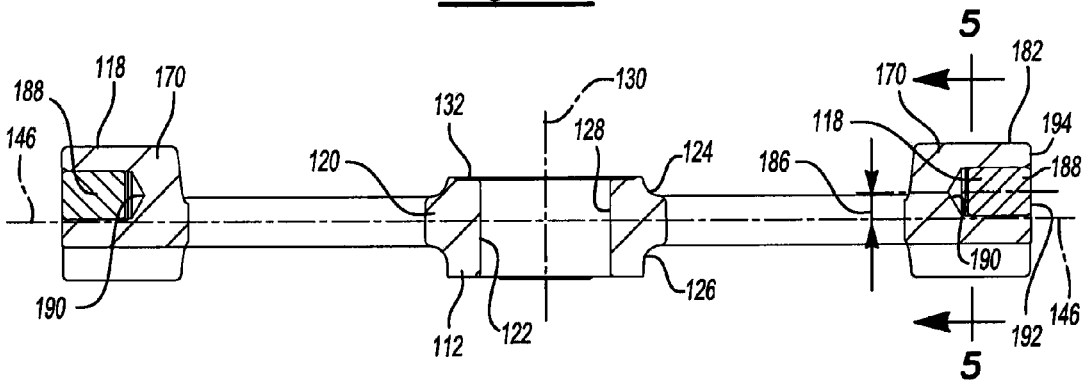
Figure 3B:
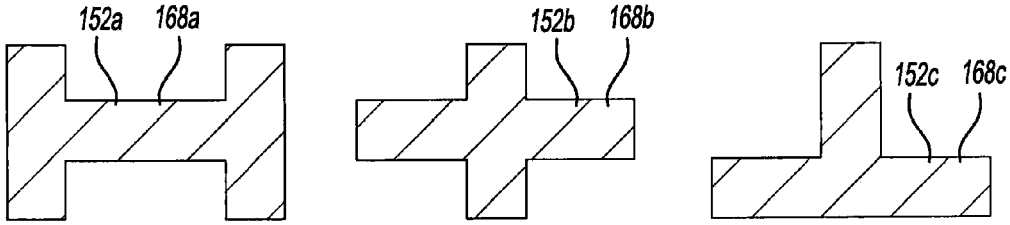
Figure 5:
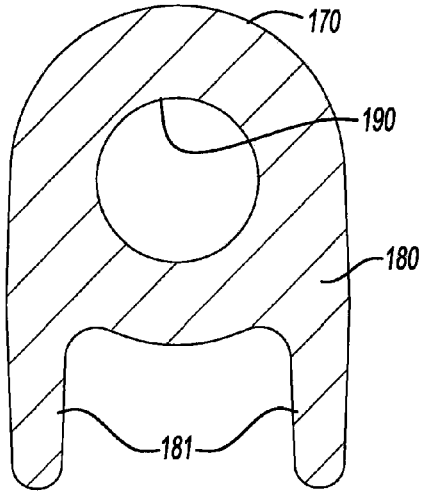
Figure 6:
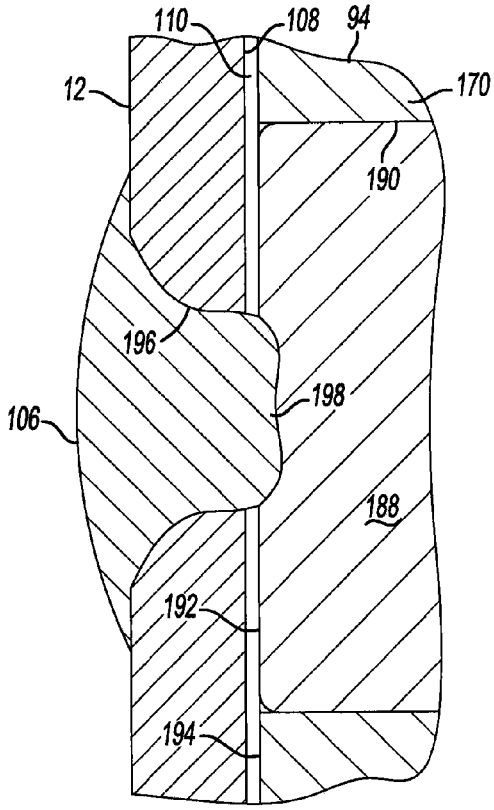
Figure 7A:
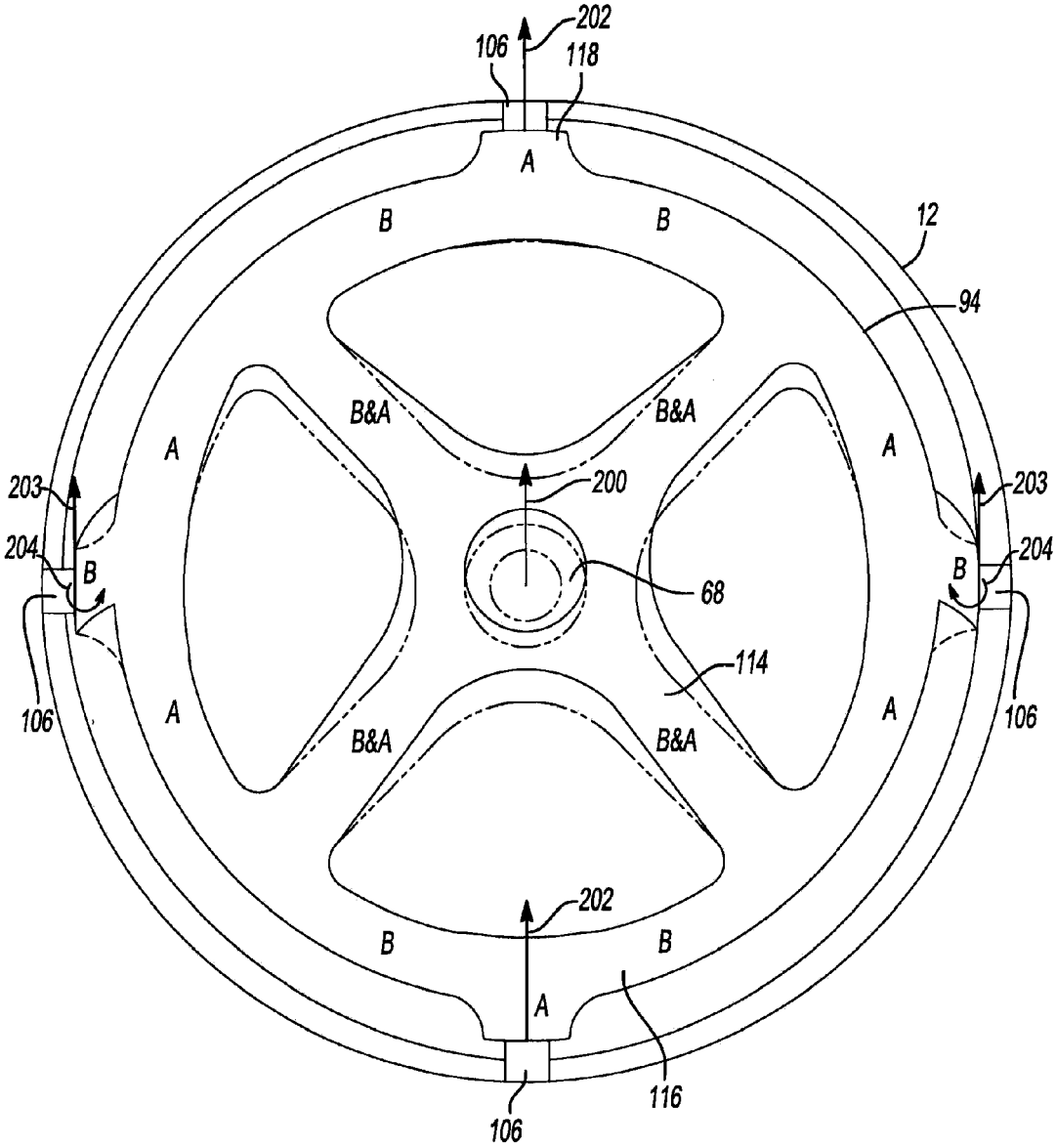
Figure 7B:
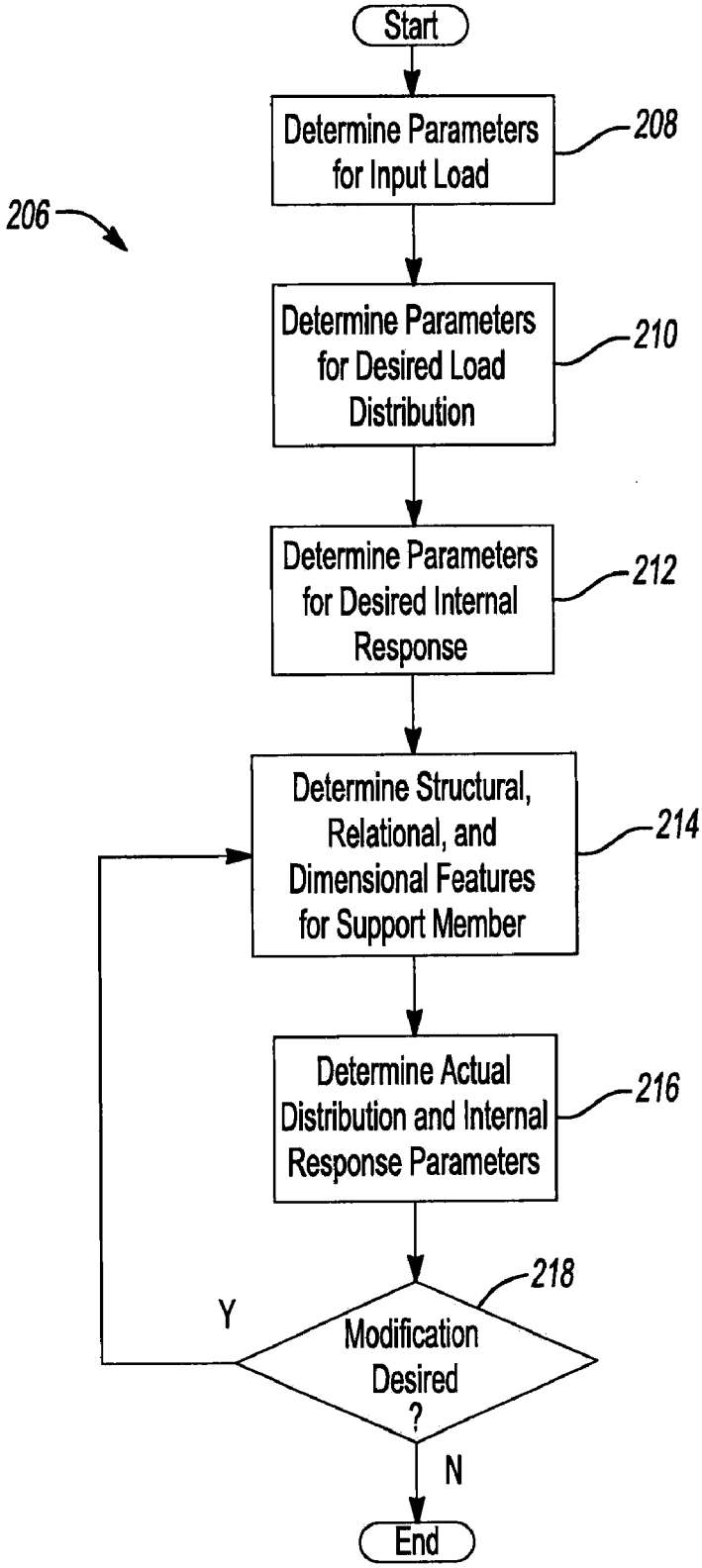
Figure 8A:
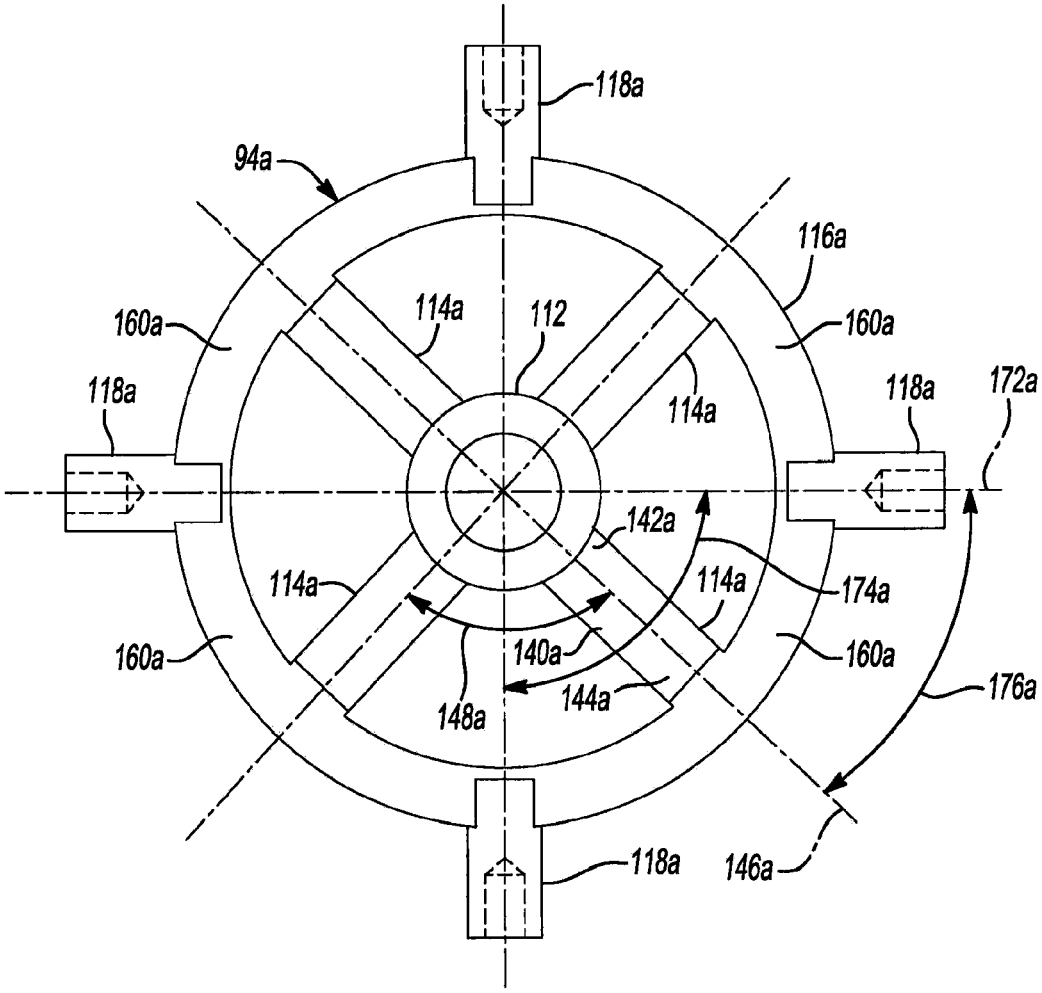
Figure 8B:
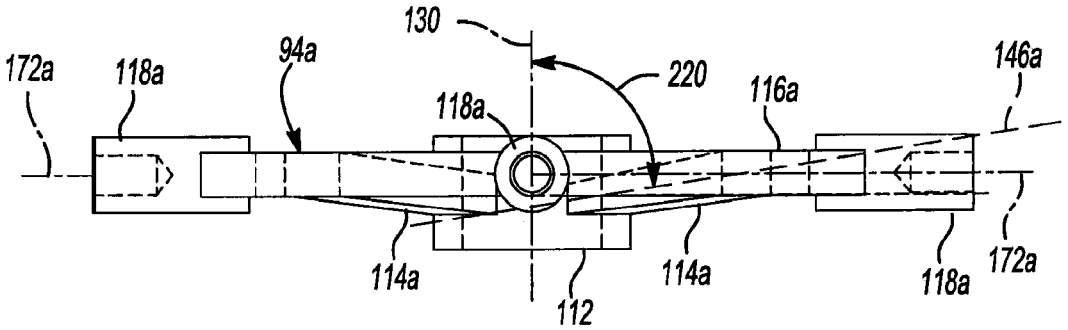

FIG. 3*a* is a top view of the support member shown in FIG. 1;

FIG. 3*b* illustrates alternate cross-sectional views of the support member shown in FIG. 1;

FIG. 4 is a front view of the support member shown in FIG. 1;

FIG. 5 is a partial cross-sectional view of the support member shown in FIG. 1;

FIG. 6 is a partial cross-sectional view of the scroll machine shown in FIG. 1;

FIG. 7*a* it a partial cross-sectional view of the scroll machine shown in FIG. 1 illustrating a loaded (solid lines) and unloaded state (dashed lines);

FIG. 7*b* is a flow diagram illustrating an exemplary method for tuning the support member shown in FIG. 1;

FIG. 8*a* is top view of a support member according to the principles of the present disclosure;

FIG. 8*b* is a front view of the support member of FIG. 8*a;*

Figure 9A:
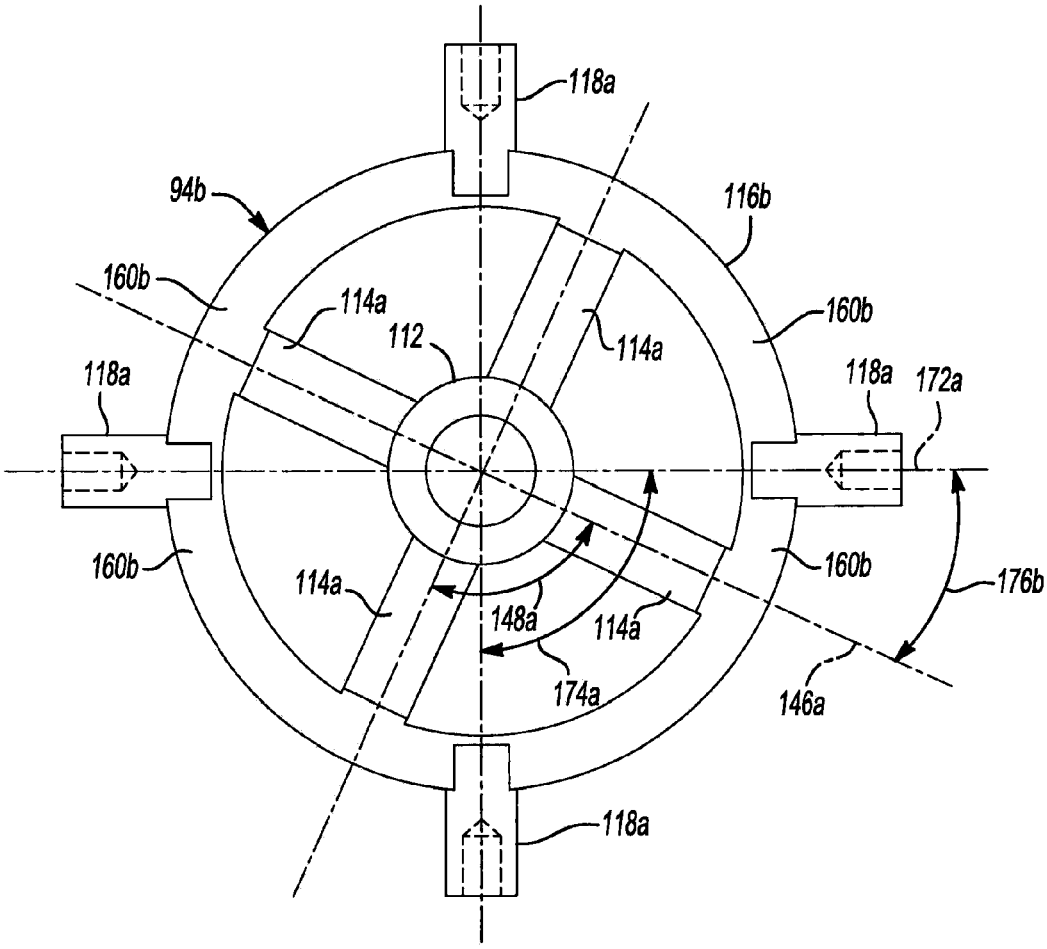
Figure 9B:
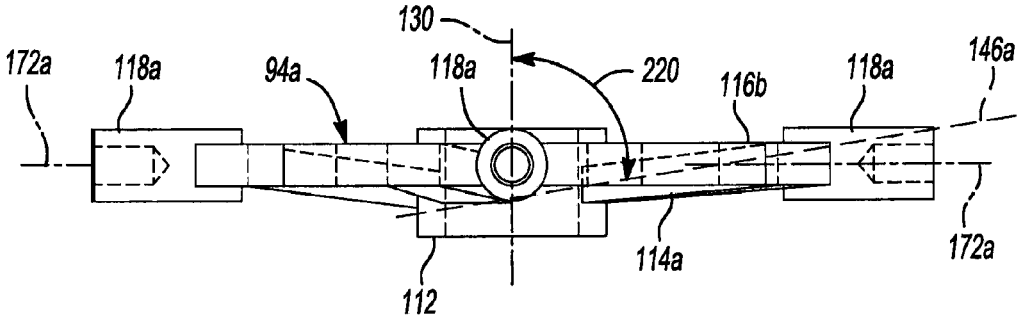

FIG. 9*a* is top view of a support member according to the principles of the present disclosure;

FIG. 9*b* is a front view of the support member of FIG. 9*a;*

Figure 10A:
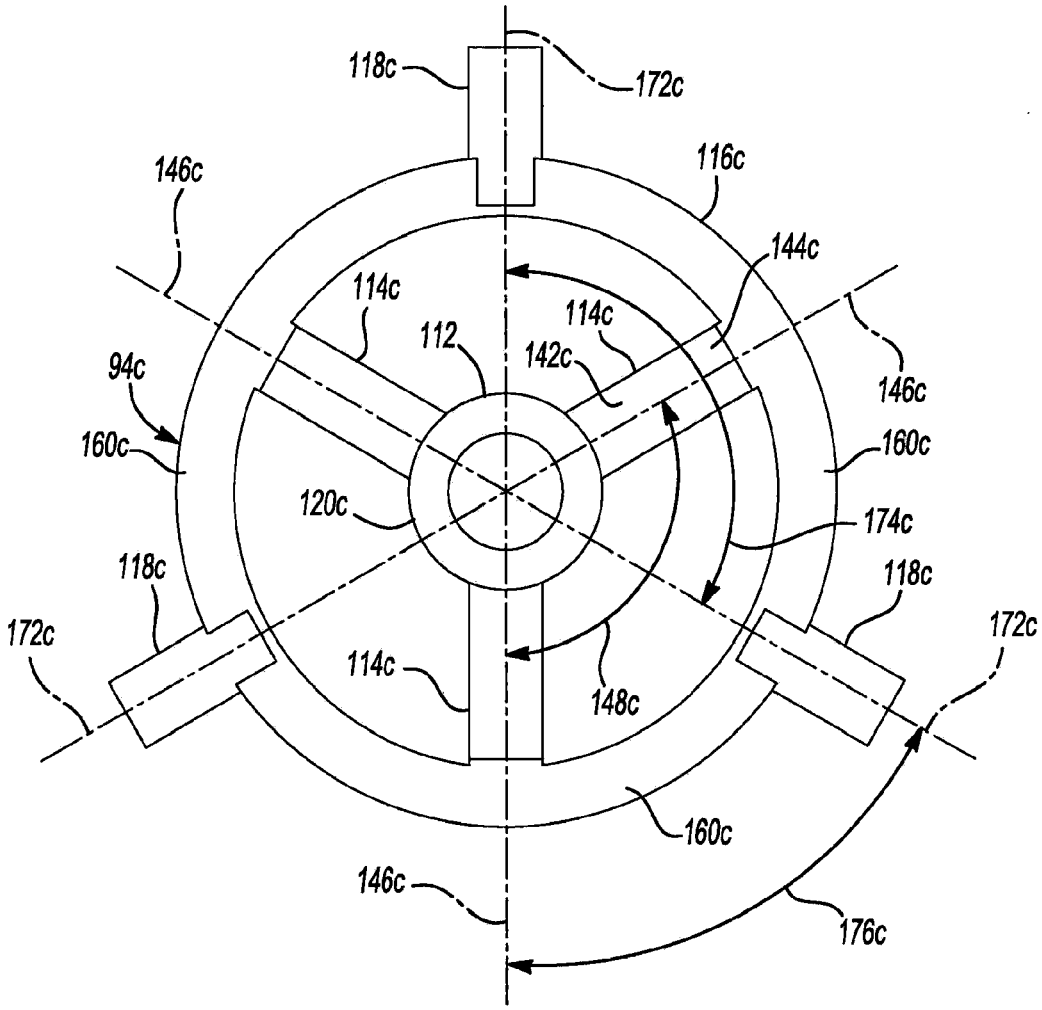
Figure 10B:
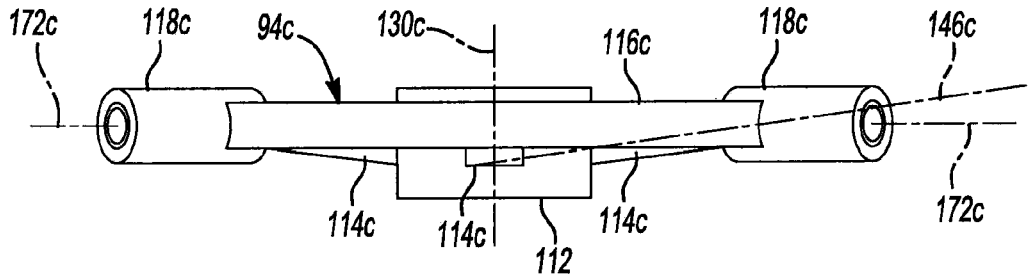

FIG. 10*a* is top view of a support member according to the principles of the present disclosure;

FIG. 10*b* is a front view of the support member of FIG. 10*a;*

Figure 11A:
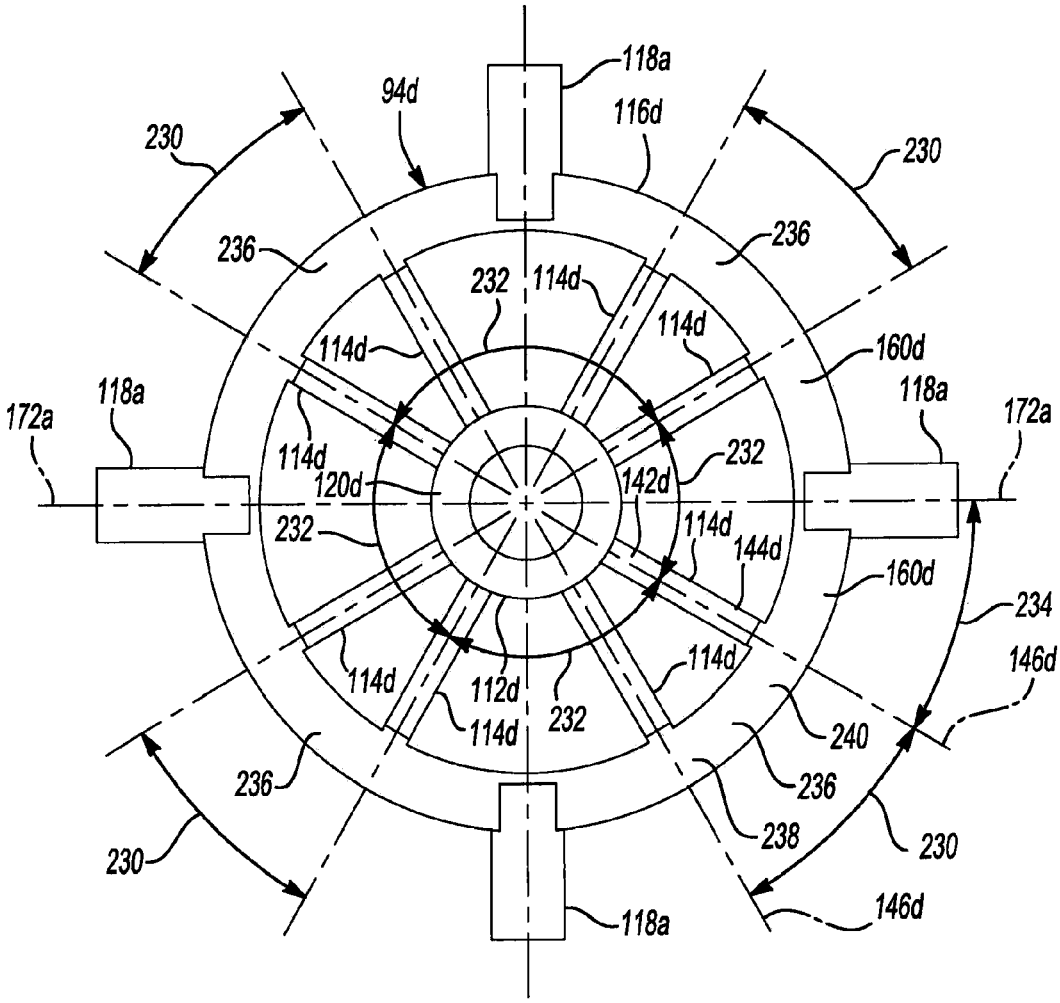
Figure 11B:
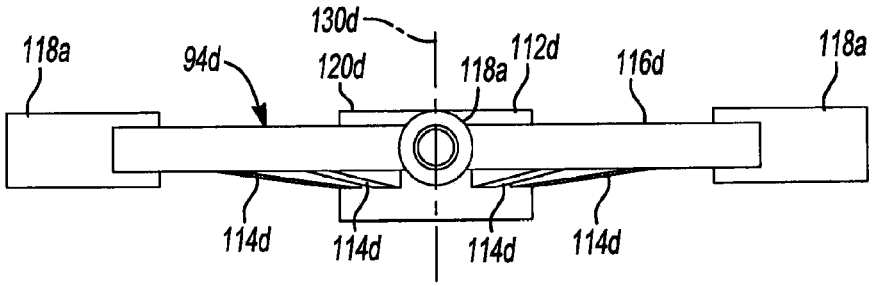

FIG. 11*a* is top view of a support member according to the principles of the present disclosure;

FIG. 11*b* is a front view of the support member of FIG. 11*a;*

Figure 12A:
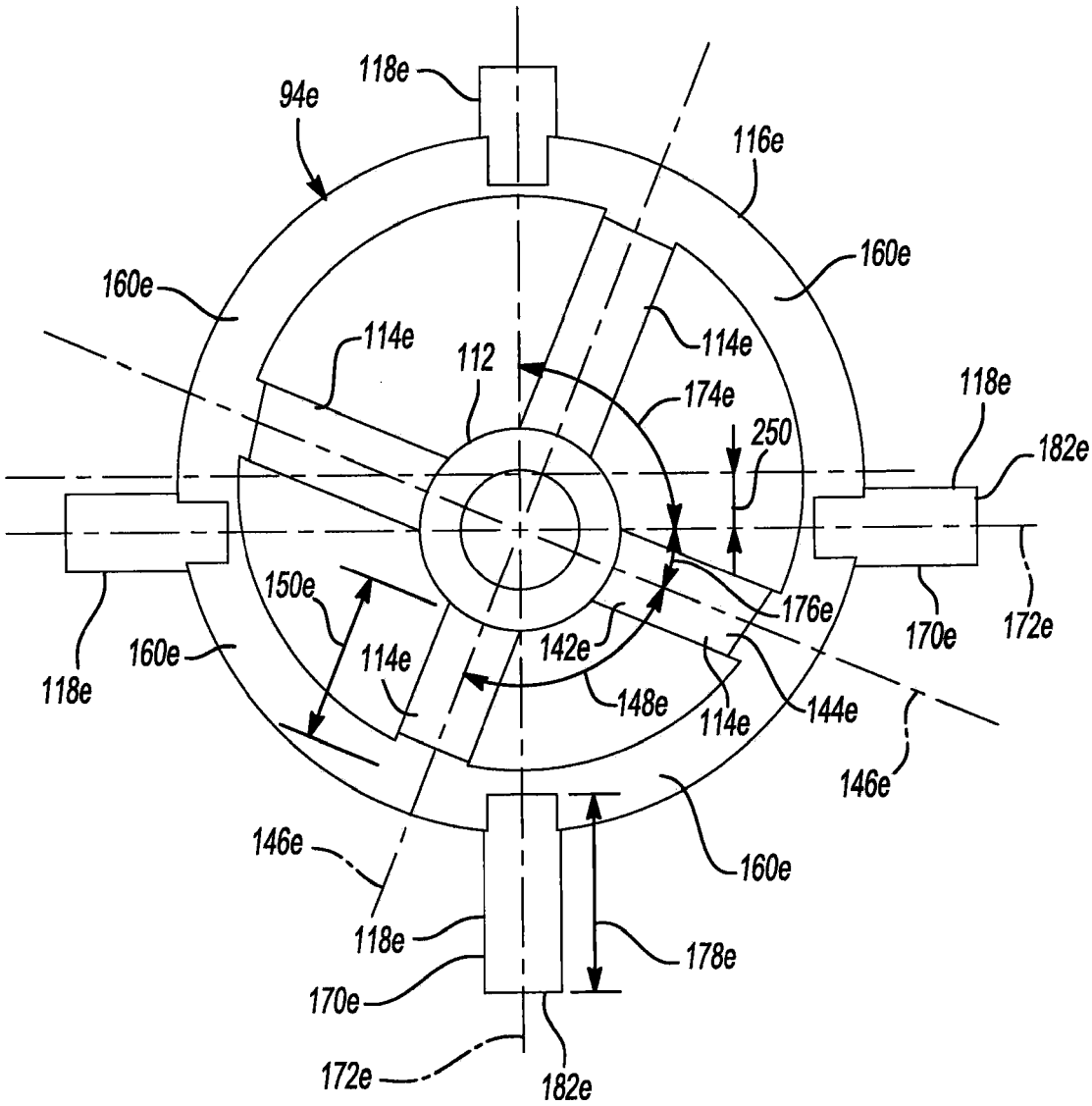
Figure 12B:
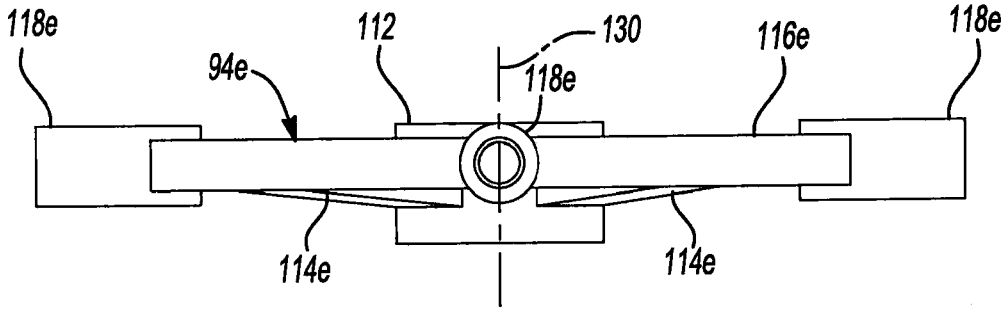

FIG. 12*a* is top view of a support member according to the principles of the present disclosure;

FIG. 12*b* is a front view of the support member of FIG. 12*a;*

Figure 13A:
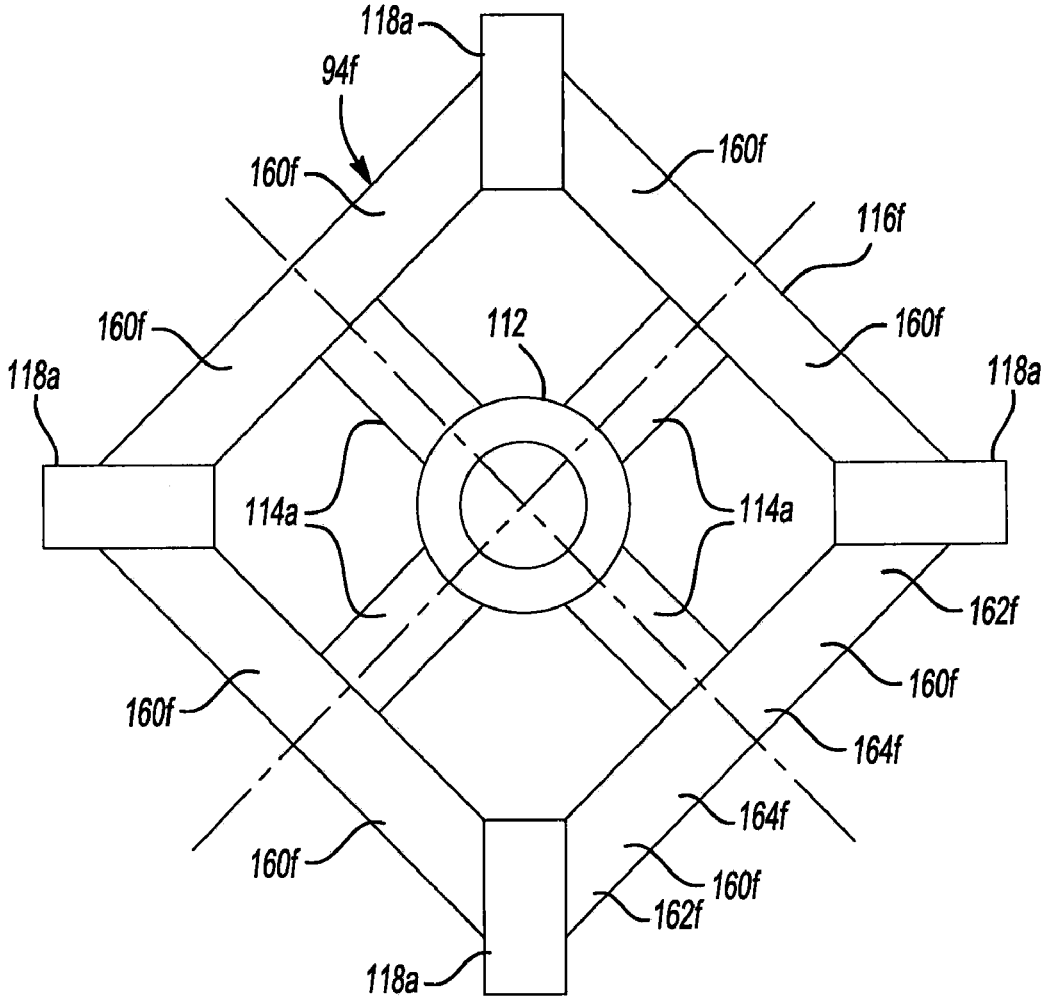
Figure 13B:
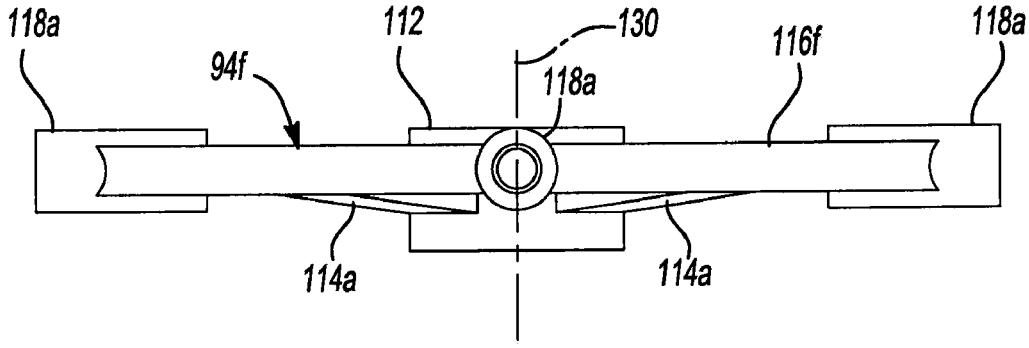

FIG. 13*a* is top view of a support member according to the principles of the present disclosure;

FIG. 13*b* is a front view of the support member of FIG. 13*a;*

Figure 14A:
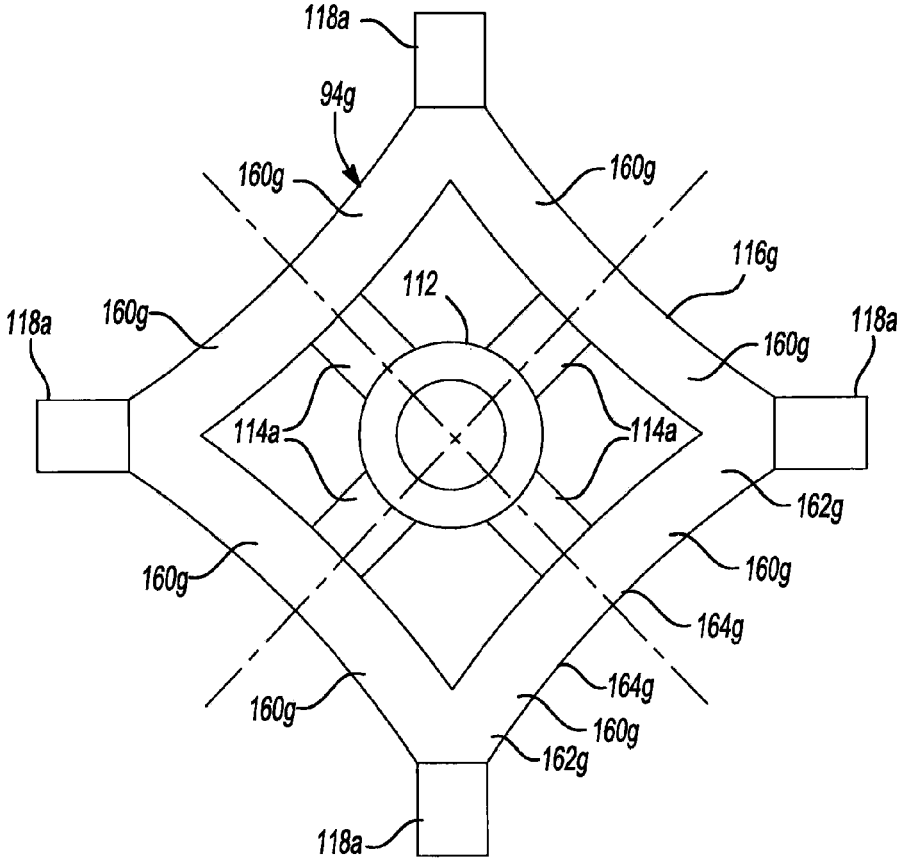
Figure 14B:
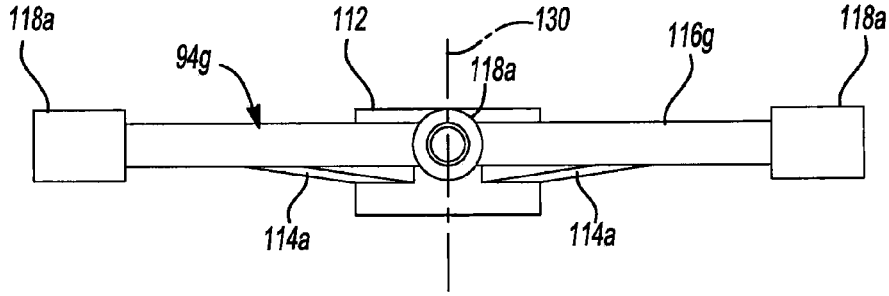

FIG. 14*a* is top view of a support member according to the principles of the present disclosure;

FIG. 14*b* is a front view of the support member of FIG. 14*a;*

Figure 15A:
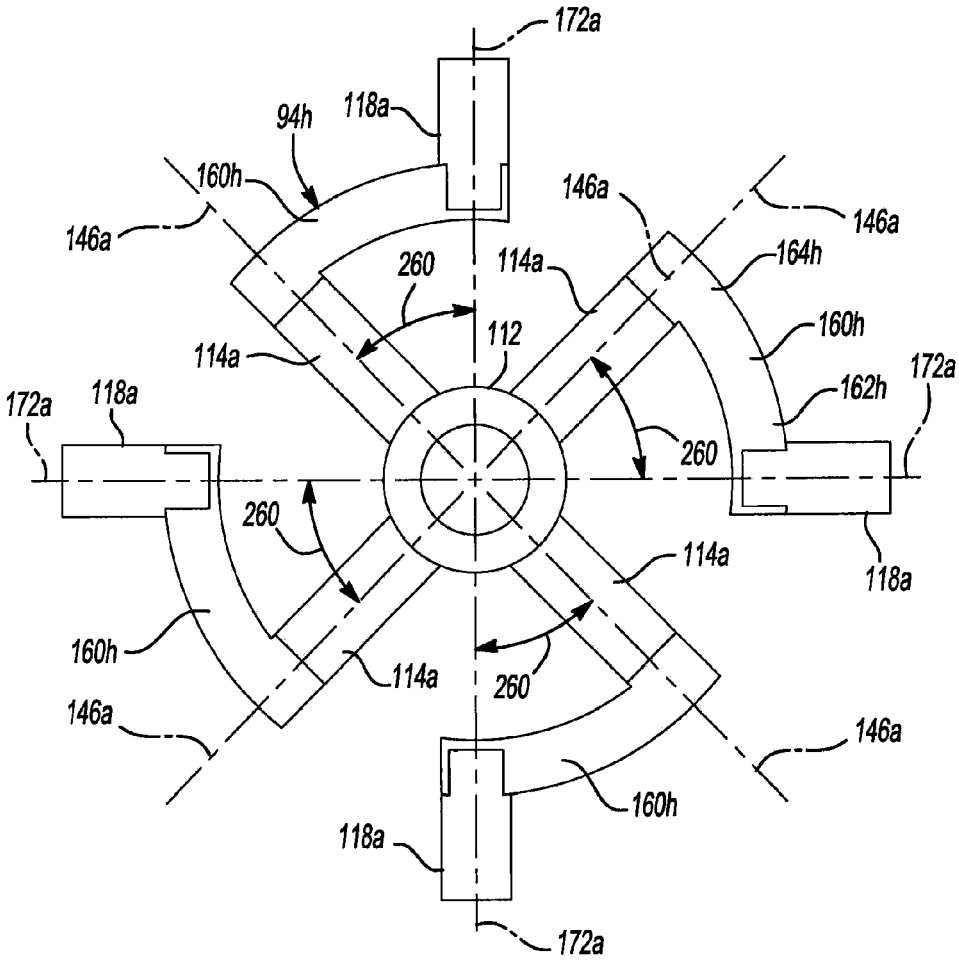
Figure 15B:
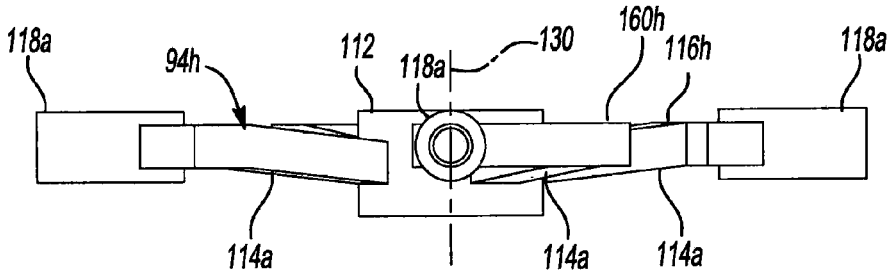

FIG. 15*a* is top view of a support member according to the principles of the present disclosure;

FIG. 15*b* is a front view of the support member of FIG. 15*a;*

Figure 16A:
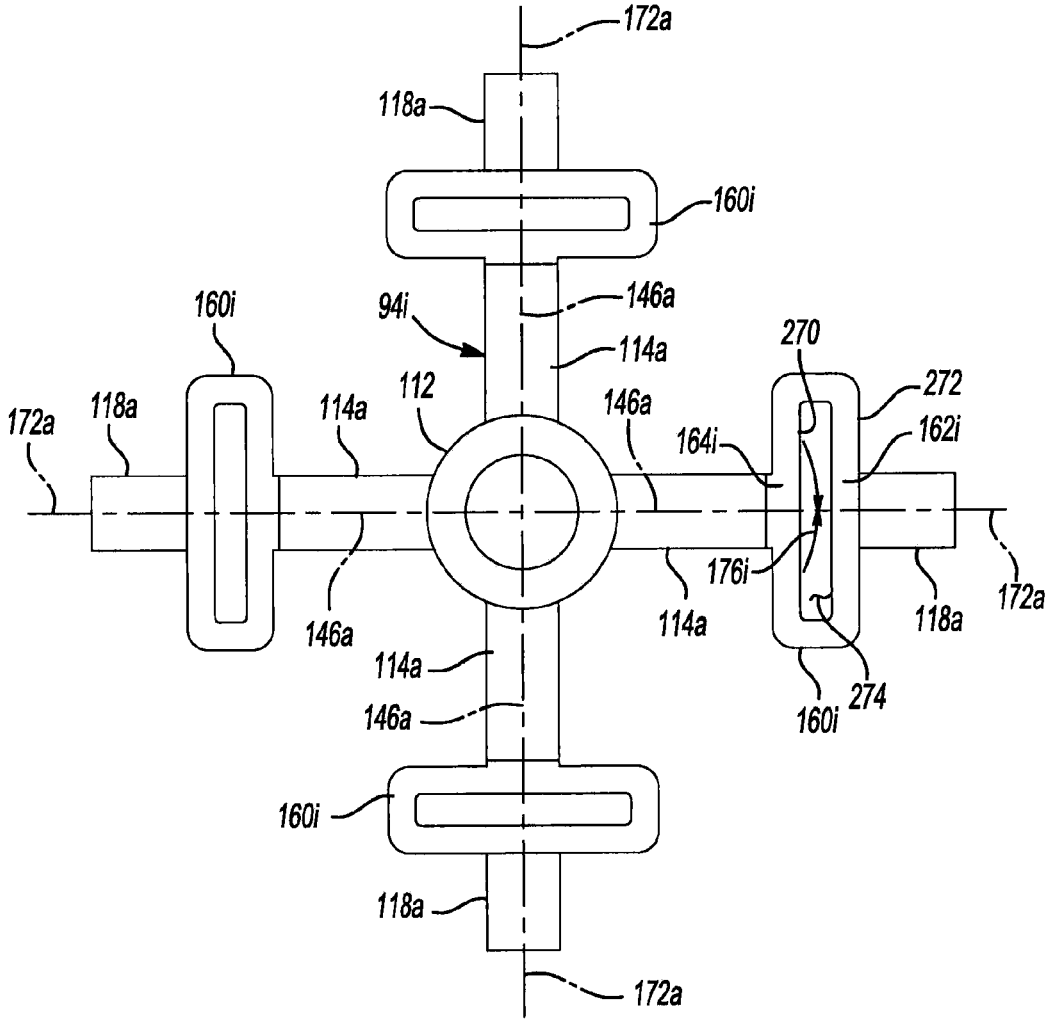
Figure 16B:
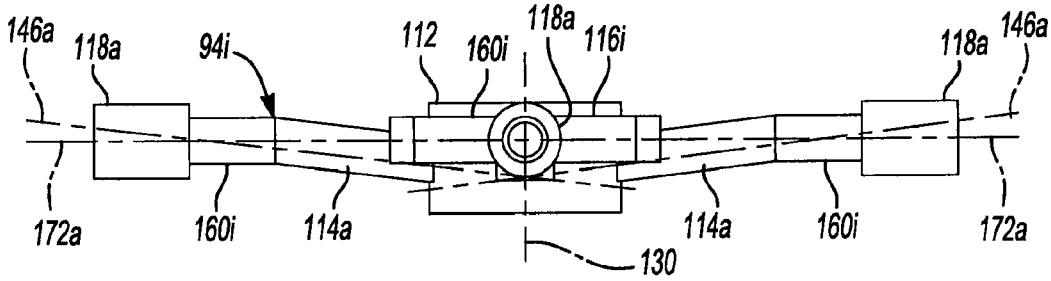

FIG. 16*a* is top view of a support member according to the principles of the present disclosure;

FIG. 16*b* is a front view of the support member of FIG. 16*a;*

Figure 17A:
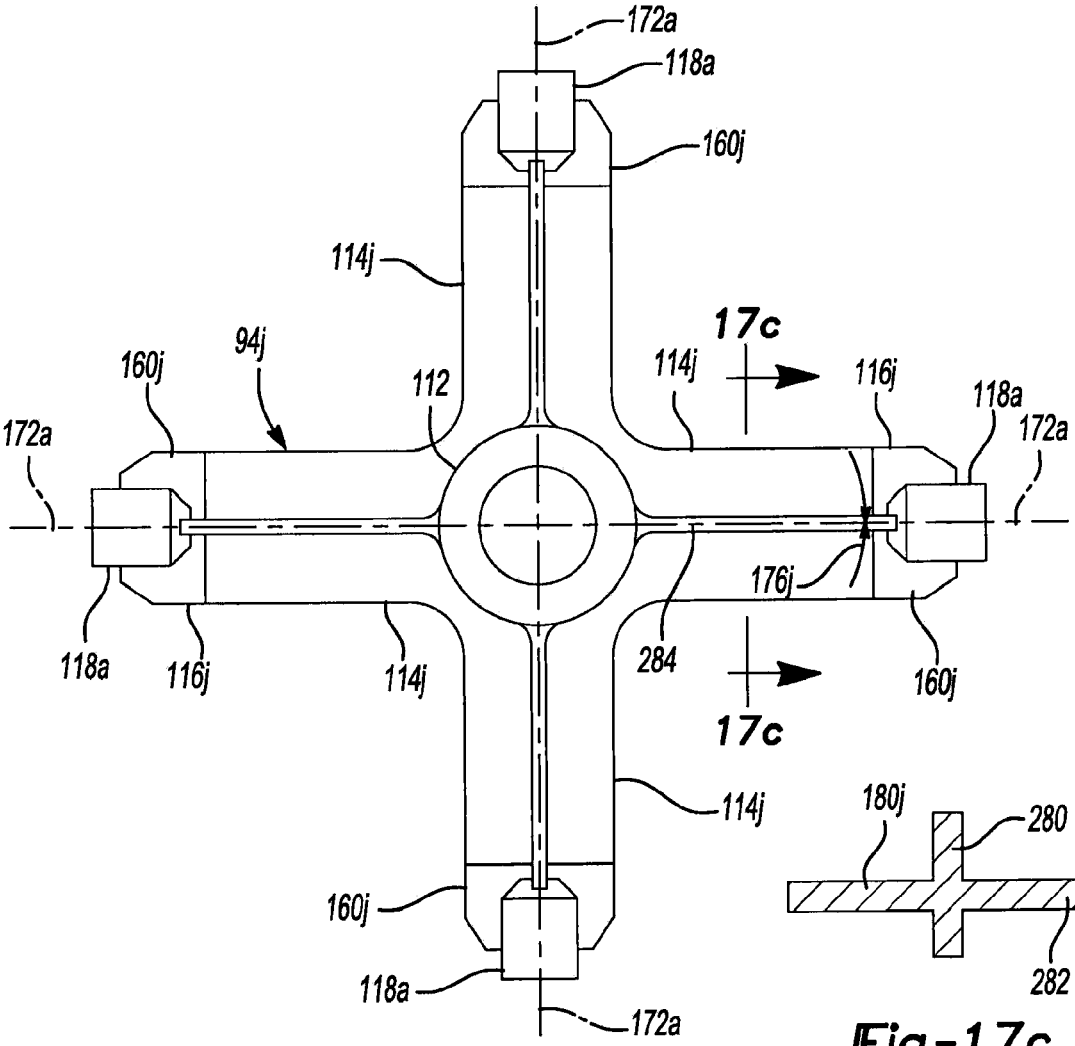
Figure 17C:
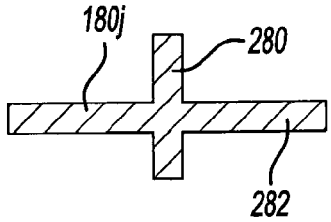
Figure 17B:
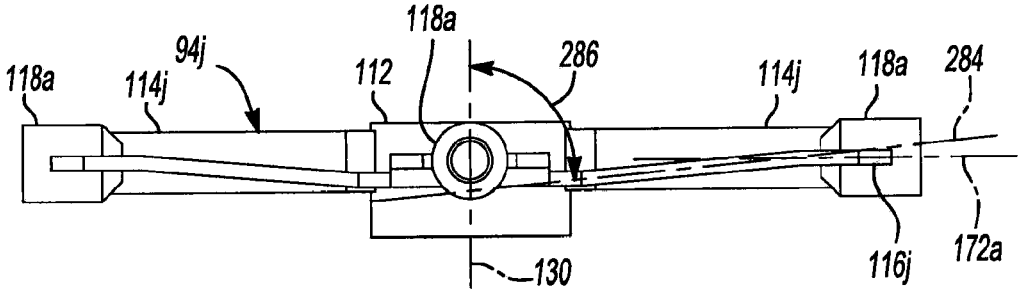

FIG. 17*a* is top view of a support member according to the principles of the present disclosure;

FIG. 17*b* is a front view of the support member shown in FIG. 17*a;*

FIG. 17*c* is a cross-sectional view of the support member shown in FIG. 17*a;*

Figure 18:
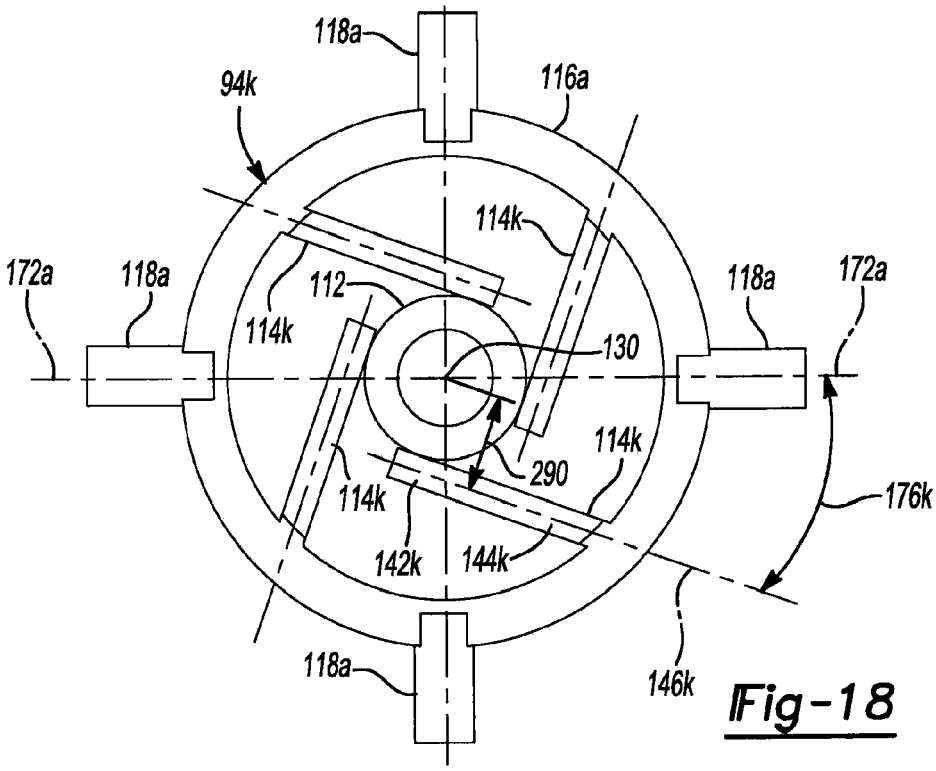
Figure 19:
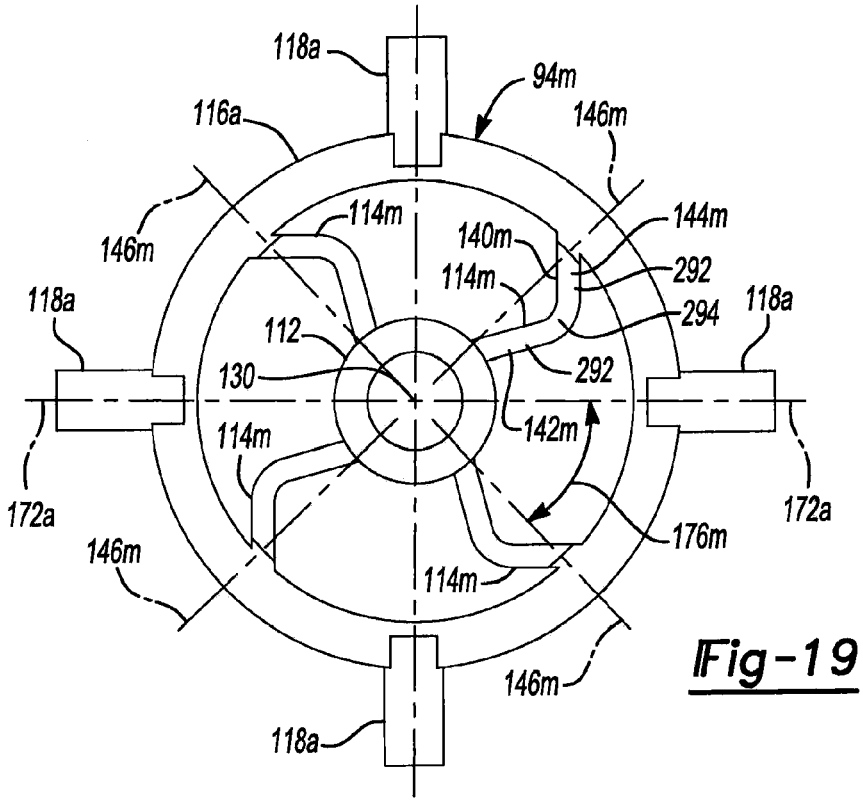
Figure 20A:
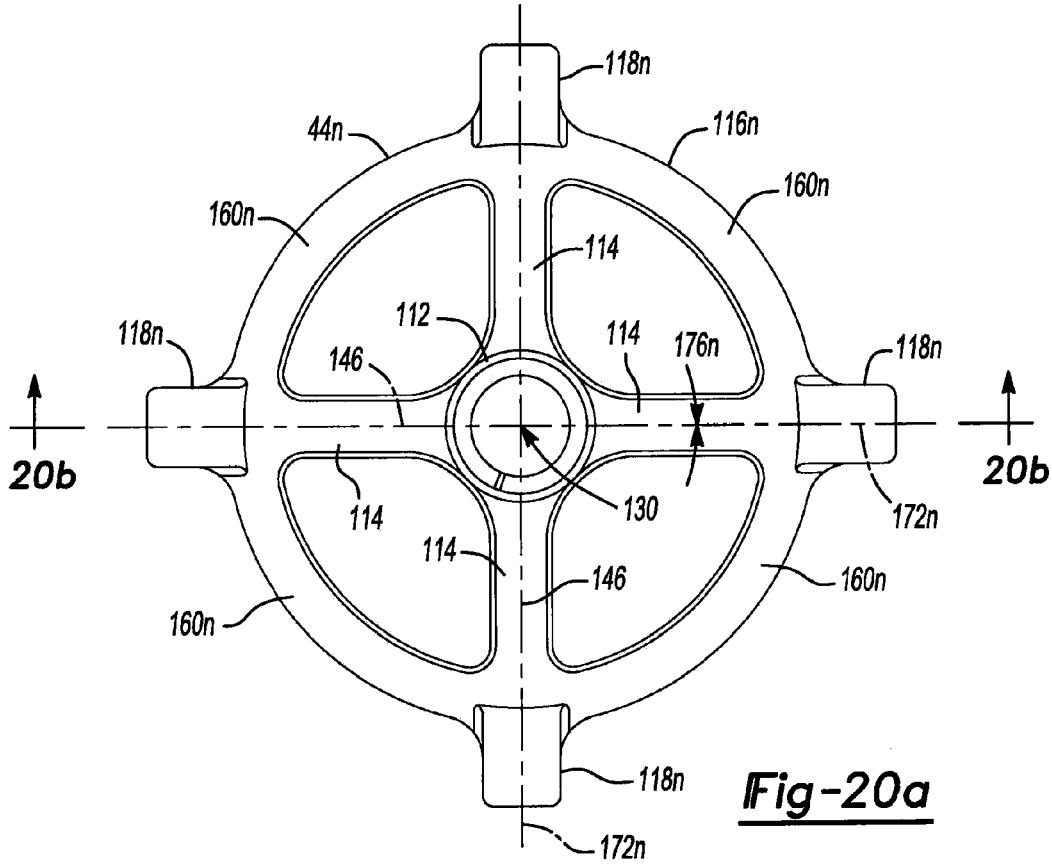
Figure 20B:
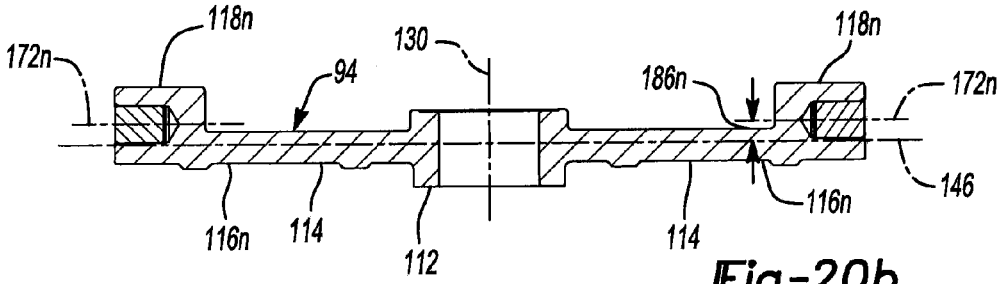

FIG. 18 is a top view of a support member according to the principles of the present disclosure;

FIG. 19 is a top view of a support member according to the principles of the present disclosure;

FIG. 20*a* is a top view of a support member according to the principles of the present disclosure; and FIG. 20*b* is a cross-sectional view of the support member shown in FIG. 20*a*.

DETAILED DESCRIPTION

The following description is merely exemplary in nature and is not intended to limit the present disclosure, application, or uses. It should be understood that throughout the drawings, corresponding reference numerals indicate like or corresponding parts and features.

With reference to FIG. 1, a scroll machine 10 is provided and includes a hermetic shell 12, a compressor section 14, and a motor-drive section 16. The hermetic shell 12 may be generally cylindrical in shape as shown. The hermetic shell 12 includes a cap 18 welded at the upper end thereof and a base 20 welded at the lower end thereof. The cap 18 may include a refrigerant-discharge fitting 22, which may have a discharge valve therein (not shown). The base 20 may include a plurality of mounting feet (not shown) integrally formed therewith. The hermetic shell 12 may further include a transversely extending partition 24 that may be welded about its periphery at the same point that the cap 18 is welded to the hermetic shell 12.

The compressor section 14 may include a compression mechanism, a non-orbiting scroll member 26, an orbiting scroll member 28, and a bearing housing 30. The non-orbiting scroll member 26 may include an end plate 32 having a spiral wrap 36 extending therefrom. The non-orbiting scroll member 26 may be secured to the bearing housing 30 and may include a plurality of embossments 40 that attach the non-orbiting scroll member 26 to the bearing housing 30 by a plurality of bolts 42.

The orbiting scroll member 28 may include an end plate 50 and a spiral wrap 52 that extends upright from the end plate 50. The spiral wrap 52 may be meshed with the spiral wrap 36 of the non-orbiting scroll member 26 to form compression chambers 54 that may fluidly communicate with a discharge port 60. The discharge port 60 may communicate with a discharge chamber 62 that may be formed by the extending partition 24 and the cap 18.

The bearing housing 30 may include a plurality of radially extending lobes 64 attached to the hermetic shell 12. The lobes 64 may be attached to the hermetic shell 12 in any suitable manner. For example, the lobes 64 may be press fit into the hermetic shell 12 such that the lobes 64 engage an inner surface of the shell. The lobes 64 may be aligned with the embossments 40 of the non-orbiting scroll member 26 and may include threaded holes 66 for receiving the bolts 42 to secure the non-orbiting scroll member 26 to the bearing housing 30.

The motor-drive section 16 may include a drive member such as a crankshaft 68 coupled to the orbiting scroll member 28 to drive the compression mechanism. The crankshaft 68 may be rotatably journaled in a bearing 72 in the bearing housing 30 and may include an eccentric shaft portion 74. The eccentric shaft portion 74 may be coupled to the orbiting scroll member 28 through a drive bushing and bearing assembly 76. The crankshaft 68 may be supported by the motor-drive section 16 at a lower end thereof, whereby the lower end of the crankshaft 68 includes a concentric shaft portion 78 and a thrust surface 79.

The lower end of the crankshaft 68 may include a concentric bore 80 that communicates with a radially inclined bore 82 extending upwardly therefrom to the top of the crankshaft 68. A lubricant flinger 84 may be disposed within the bore to pump fluid 85 disposed in the lower end of the hermetic shell (e.g., within the base 20) through the bores 80, 82 to the compressor section 14 and other portions of the scroll machine 10 requiring lubrication. The lubricant flinger 84 may be of the type disclosed in Assignee's commonly owned U.S. Pat. No. 7,179,069, the disclosure of which is incorporated herein by reference.

Upper and lower counterweights 86, 88 may be attached to the crankshaft 68. Additionally, a counterweight shield 90 may also be provided to reduce the work loss caused by the lower counterweight 88 coming in contact with lubricant disposed within the hermetic shell 12. The counterweight shield 90 may be of the type disclosed in Assignee's commonly owned U.S. Pat. No. 5,064,356, the disclosure of which is incorporated herein by reference.

The motor-drive section 16 may further include a motor assembly 92 and a lower bearing support member 94. The motor assembly 92 may be securely mounted in the hermetic shell 12 and may include a stator 96, windings 98, and a rotor 100. The stator 96 may be press fit in the hermetic shell 12, while the rotor 100 may be press fit on the crankshaft 68. The stator 96, windings 98, and rotor 100 may work together to rotatively drive the crankshaft 68 and thereby cause the orbiting scroll member 28 to orbit relative to the non-orbiting scroll member 26 when the motor assembly 92 is energized.

The support member 94 may be attached to the hermetic shell 12 and may rotatably support the crankshaft 68. To this end, the support member 94 may work together with the bearing housing 30 to define a vertical axis 102 about which the crankshaft 68 rotates. The support member 94 may also axially support the crankshaft 68 by providing support in the vertical direction along vertical axis 102 and may be used to fix the axial position of the lower end of the crankshaft 68 within the hermetic shell 12. Additionally, the support member 94 may be used to inhibit vertical movement of the crankshaft 68 in a downward direction generally toward the base 20. In the foregoing manner, the support member 94 also may work together with the bearing housing 30 to define a motor air gap 104 between the stator 96 and the rotor 100.

The support member 94 may be attached to the hermetic shell 12 in any suitable manner. For example, the support member 94 may be staked to the shell in a manner similar to that described in Assignee's commonly owned U.S. Pat. No. 5,267,844, the disclosure of which is incorporated herein by reference. Alternatively or additionally, the support member 94 may be attached to the hermetic shell 12 using a plurality of fasteners (not shown).

The support member 94 may be attached to the hermetic shell 12 using a plurality of plug welds 106. The support member 94 may slidably engage an inside wall 108 of the hermetic shell 12 or, alternatively, may be spaced part from the shell 12 by a series of gaps 110 located between the support member 94 and the inside wall 108 of the hermetic shell 12. In the foregoing manner, the precise position of the support member 94 within the hermetic shell 12 may be adjusted in both the vertical and horizontal directions during the assembly of the scroll machine 10.

The support member 94 receives loads from the crankshaft 68 and transmits the loads in a predetermined way to the points where the support member 94 is attached to the hermetic shell 12 (e.g., welds 106). Attachment of the support member 94 to the hermetic shell 12 provides a load path between the crankshaft 68 and the hermetic shell 12. As such, the support member 94 transmits loads to the hermetic shell 12 via the welds 106 in a manner that reduces stresses in the welds 106 and attenuates the vibration response of the support member 94 in response to cyclical loads transmitted by the crankshaft 68 to the support member 94. The support member 94 may be tuned during development of the scroll machine 10 and the support member 94 to achieve a desired load distribution and vibration response.

With reference to FIGS. 2-5, the support member 94 may include a hub 112, three or more inner spokes 114, a rim 116, and three or more outer spokes 118. Together, the hub 112, the inner spokes 114, the rim 116, and the outer spokes 118 work together to distribute loads to the hermetic shell 12. The hub 112, inner spokes 114, rim 116, and outer spokes 118 may be integrally formed as a single component by a suitable manufacturing process such as, for example, casting or forging.

The choice of material for the support member 94 can vary and may generally depend on considerations that include the nature of the loads received by the support member 94, the desired vibration response of the support member 94, a desired mass of the support member 94, the method of attaching the support member 94 to the hermetic shell 12, and the material chosen for the hermetic shell 12. In one configuration, the hermetic shell 12 is formed from steel and the hub 112, inner spokes 114, rim 116, and outer spokes 118 are die cast from A380 Aluminum.

A body 120 of the hub 112 may be connected to an end portion of each of the inner spokes 114 and may rotatably support the lower end of the crankshaft 68. To this end, the body 120 may include a through bore 122 extending between upper and lower ends 124, 126 that receives the concentric shaft portion 78 of the crankshaft 68. The upper end 124 may define a plain bearing surface 128 for slidably supporting the concentric shaft portion 78. If the support member 94 is formed from Aluminum, such as A380 Aluminum, the A380 Aluminum material itself may provide a suitable bearing surface.

The hub 112 may alternatively include a bushing (not shown) press fitted into the bore 122 that provides the bearing surface 128. Such a bushing may provide additional serviceability to the support member 94 by providing a replaceable bushing. The hub 112 may alternatively include a roller bearing (not shown) press fitted into the bore 122 having an inner race press fitted onto the crankshaft 68. The hub 112 may alternatively include a magnetic bearing (not shown). The hub 112 will be described hereinafter and shown in the drawings as having a single bore 122 defining the bearing surface 128.

The bearing surface 128 may define an axis 130 about which the inner spokes 114, rim 116, and outer spokes 118 are arranged. Axis 130 of the hub 112 aligns with vertical axis 102 of the crankshaft 68 when the concentric shaft portion 78 is located within the bore 122.

The hub 112 may further include a planar thrust surface 132 disposed adjacent to the bearing surface 128 that mates with the thrust surface 79 of the crankshaft 68 and is substantially normal to axis 130. The support member 94 may provide axial support for the crankshaft 68 via interaction between thrust surface 132 of the hub 112 and surface 79 of the crankshaft 68.

The inner spokes 114 may each include a body 140 that defines inner and outer ends 142, 144 that connect the inner spokes 114 to the body 120 and the rim 116, respectively. While three or more inner spokes 114 may be provided, the support member 94 will be described hereinafter and shown in the drawings as including four inner spokes 114. Each of the inner spokes 114 may radially extend from the body 120 along a corresponding axis 146 defined by the inner and outer ends 142, 144. While axis 146 of each of the inner spokes 114 is shown to intersect axis 130 of the hub 112, axis 146 may be offset from axis 130 such that axis 146 does not intersect axis 130.

While the body 140 may be a generally straight, elongate member that extends along axis 146, the body 140 may alternatively be a curved, elongate member that includes one or more bends about axis 146 between the inner and outer ends 142, 144.

The inner spokes 114 may be located at any rotational position about axis 130 to provide a particular angular arrangement of the inner spokes 114. For example, the inner spokes 114 may be arranged about axis 130 in a symmetrical manner, as shown in FIGS. 2-5. Accordingly, included angles 148 between adjacent inner spokes 114, as measured around axis 130, are substantially equal to one another. When four inner spokes 114 are provided, the included angles 148 between adjacent inner spokes may be substantially equal to 90 degrees. However, the included angles 148 between adjacent inner spokes 114 may be unequal to tune the support member 94, as will be described further below.

The body 140 of each of the inner spokes 114 has a length 150 and a cross-sectional area 152 (FIG. 3). While the length 150 of each of the inner spokes may vary, the length 150 of each of the inner spokes 114 is substantially equal in FIGS. 2-5. Furthermore, while the cross-sectional area 152 may vary both along the length of each of the inner spokes 114 and among the inner spokes 114, the cross-sectional area 152 of the support member shown in FIGS. 2-5 is substantially equal along the length of each of the inner spokes 114 and between the inner spokes 114. The cross-sectional area 152 will be described hereinafter and shown in the drawings as having a generally rectangular in shape. The cross-sectional area 152 may be chosen to provide the inner spokes 114 with a desired axial stiffness and horizontal and vertical bending stiffnesses to tune the support member 94. For example, the cross-sectional area 152 may be chosen, but not limited to, those shown in FIG. 3*b*.

Figure 2:
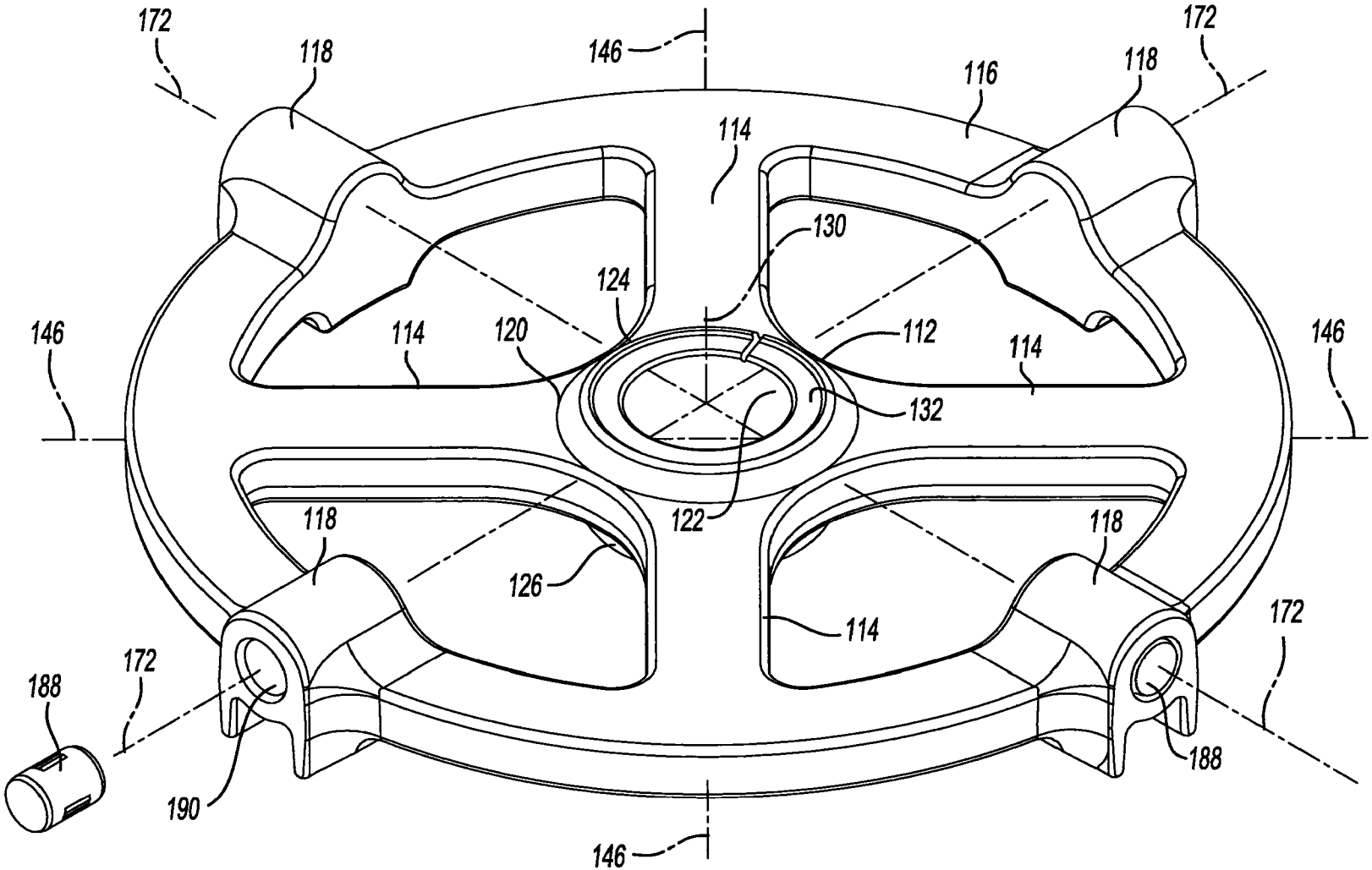
FIG. 2 is an isometric view of the support member shown in FIG. 1.

The rim 116 may be disposed between the inner spokes 114 and the outer spokes 118 and may connect the inner spokes 114 to the outer spokes 118. To this end, the rim 116 may be generally ring-shaped, as shown in FIGS. 2-3. The rim 116 may include connecting portions 160 defining first and second ends 162, 164 that connect one of the outer spokes 118 to a corresponding one of the inner spokes 114, respectively. Each of the outer spokes 118 may be connected to a corresponding one of the inner spokes 114 by one of the connecting portions 160. Alternatively, each of the outer spokes 118 may be connected to two adjacent inner spokes 114 by a pair of corresponding connecting portions 160 to form a continuous ring-shaped rim 116.

Each of the connecting portions 160 has a length 166 and a cross-sectional area 168 (FIG. 3). The length 166 of each of the connecting portions 160 may be determined based on a desired position or arrangement of the outer spokes 118 with respect to the inner spokes 114. The cross-sectional area 168 of each of the connecting portions 160 may vary both along the length 166 of each of the connecting portions 160 and among the connecting portions 160. However, as described hereinafter and shown in the drawings, the cross-sectional area 168 of the connecting portions 160 is generally rectangular in shape and substantially equal along the length of each of the connecting portions 160 and among the connecting portions 160. The cross-sectional area 168 may be chosen to provide the connecting portions 160 with a desired axial stiffness and horizontal and vertical bending stiffnesses to tune the support member 94. For example, the cross-sectional area 168 may be chosen, but not limited to, those shown in FIG. 3*b*.

The outer spokes 118 may be disposed between the rim 116 and the hermetic shell 12 to attach the support member 94 to the hermetic shell 12. The outer spokes 118 may work together with the rim 116 and the inner spokes to position the hub 112 in a desired position within the hermetic shell 12. Generally, the hub 112 may be positioned within the hermetic shell 12 such that axis 130 extends along a center of the hermetic shell 12. The outer spokes 118 may include a body 170 that is connected to the first end 162 of a corresponding one of the connecting portions 160. The body 170 may extend from the connecting portions 160 along an axis 172 that is generally defined by the hub 112 and the first end 162 (FIG. 3). Thus, the outer spokes 118 may extend from the connecting portions 160 in a radial direction with respect to the hub 112.

The outer spokes 118 may be arranged about axis 130 of the hub 112 in a symmetrical manner. Accordingly, included angles 174 between the body 170 of adjacent outer spokes 118, as measured around axis 130, will be substantially equal to one another. As shown in FIGS. 2-5, the included angles 174 may be substantially equal to ninety degrees. The included angles 174 between adjacent outer spokes 118 may also be unequal as desired to tune the support member 94 as will be described in further detail below.

The outer spokes 118 may be located at a particular rotational position about axis 130 to provide a desired angular arrangement of the outer spokes 118 with respect to the inner spokes 114. In particular, the body 170 of each of the outer spokes 118 may be positioned at a rotational angle 176 with respect to axis 146 of a corresponding one of the inner spokes 114, as measured in a counter clock-wise direction around axis 130 in the view shown in FIG. 3. While the outer spokes 118 may be arranged such that the angle 176 is substantially one-half the included angles 148 as shown in FIGS. 2-5, the angle 176 between the inner spokes 114 and the outer spokes 118 may vary to position the outer spokes 118 nearer to an adjacent inner spoke 114. As described herein and shown in the drawings, the angle 176 is substantially equal to forty-five degrees.

The body 170 has a cross-sectional area 180, as shown in FIG. 5. The cross-sectional area 180 may vary both along axis 172 and between the outer spokes 118. As shown in FIG. 5, the cross-sectional area 180 may be substantially equal among the outer spokes 118 and along axis 172 of each of the outer spokes 118 and may be generally cylindrical. The cross-sectional area 180 may further define a pair of fixturing legs 181 that may be used during assembly of the scroll machine 10 to allow the support member 94 to be grasped and subsequently positioned within the hermetic shell 12.

The body 170 includes a distal end 182 which is located along axis 172 a length 178 (FIG. 3) away from the first end 162. The length 178 may vary to allow the distal end 182 to be used to attach the support member 94 to the hermetic shell 12. The distal end 182 may be located at a vertical distance 186 above axis 146 (FIG. 4) and may include a threaded connection (not shown) for attaching the support member 94 to the hermetic shell 12. Alternatively, the distal end 182 may be welded to the hermetic shell 12, as previously described. Where the distal end 182 is formed from a material dissimilar to that of the hermetic shell 12, the distal end 182 may include a weld insert 188 to facilitate welding of the outer spokes 118 to the hermetic shell 12.

The weld insert 188 may formed of any suitable material that can be welded to the hermetic shell 12 and may be press fitted into a blind bore 190 to securely position the weld insert 188 in the body 170. When the weld insert 188 is fully seated within the blind bore 190, a joining face 192 of the weld insert 188 may be disposed generally flush with an end face 194 of the distal end 182 or may protrude from the distal end 182.

With particular reference to FIG. 6, the welds 106 used to join the support member 94 to the hermetic shell 12 include fusion zones 196, 198 located at the interfaces between the welds 106 and the hermetic shell 12 and the welds 106 and the outer spokes 118. The loads received by the hub 112 from the crankshaft 68 are transmitted to the hermetic shell 12 through the fusion zones 196, 198.

Structural, dimensional, and relational features of the various elements of the support member 94 may be adjusted to develop alternate configurations and thereby tune the support member 94. For example, structural features of the support member 94 such as, but not limited to, the number of inner spokes 114, connecting portions 160, and outer spokes 118 may be adjusted to achieve a desired load distribution among the various elements of the support member 94 and vibration response of the support member 94.

Similarly, dimensional features of the support member 94 such as, but not limited to, the length 150 and the cross-sectional area 152 of the inner spokes 114, the length 166 and the cross-sectional area 168 of the connecting portions 160 of the rim 116, and the length 178 and the cross-sectional area 180 of the body 170 of the outer spokes 118 may be adjusted to achieve desired axial and bending stiffnesses among the various elements of the support member.

Relational features of the support member 94 may also be adjusted to achieve a desired positioning or arrangement of the elements of the support member 94 and thereby tune the support member 94. For example, relational features such as, but are not limited to, the angles 148 between the inner spokes 114, the included angles 174 between the outer spokes 118, the angle 176 between the inner and outer spokes 114, 118, and the vertical distance 186 of the distal end 182 above the center of the hub 112 may be adjusted to achieve a desired load distribution among the welds 106 and vibration response of the support member 94.

The structural, dimensional, and relational features of the support member 94 may be chosen to provide a support member that transmits loads in a predetermined manner and exhibits a desired vibration response to the loads. Thus, the support member 94 may be tuned to improve the reliability of the welds 106 and the noise generated during operation of the scroll machine 10.

More specifically, the support member 94 may be adjusted to reduce stresses in the welds 106 by distributing loads transmitted to the support member 94 by the crankshaft 68 in a controlled fashion. Additionally, the support member 94 may be adjusted to attenuate the noise generated by the vibration of the support member 94 in response to cyclical loads that are transmitted by the crankshaft 68 to the support member 94.

Referring now to FIGS. 7*a*-7*b*, exemplary methods of tuning the support member 94 by determining the structural, dimensional, and relational parameters for the support member 94 will be described in detail. With particular reference to FIG. 7*a* an instant load on the support member 94 is depicted using the reference numeral 200. As used herein, the load 200 refers to the load imparted by the crankshaft 68 to the support member 94, but is not limited as such. The load applied to the support member 94 may find its origin at any location within or external to the scroll machine 10.

Generally, in a device such as the scroll machine 10, the load 200 will be a cyclical load that fluctuates in magnitude. Additionally, depending on the particular device, the load 200 may be directional. In other words, the load 200 may be imparted in a generally consistent direction related to the rotational position of the crankshaft 68.

The load 200 is distributed throughout the support member 94 in the form of internal forces that are, in turn, transferred to the welds 106 via the outer spokes 118. More particularly, the load 200 is distributed among the inner and outer spokes 114, 118 and the rim 116 based on the particular structural, dimensional, and relational features of the support member 94.

The internal forces generated by the load 200 induce internal stresses in the inner and outer spokes 114, 118 and the rim 116 that, for simplicity, may be generally characterized as axial stresses and bending stresses. The axial stresses in the support member 94 generated by the load 200 are generally depicted using the reference letter "A". The bending stresses generated in the support member 94 by the load 200 are generally depicted using the reference letter "B". Depending on the load 200, bending stresses may be induced in the support member 94 in both horizontal and vertical directions.

The axial and bending stresses that are induced in the outer spokes 118 will, in turn, affect the magnitude and nature of loads that are transmitted to the welds 106. For example, axial loads 202 and lateral or shear loads 203 may be transmitted to the welds 106. Additionally, bending loads 204 may also be transmitted to the welds 106. The axial, shear, and bending loads 202, 203, 204 transmitted to the welds 106 cause stresses of a particular magnitude and nature (i.e., axial or bending stresses) to develop in the welds 106.

With particular reference to FIG. 7*b*, an exemplary method 206 for tuning the support member 94 to achieve a desired internal response of the support member 94 and a desired external response of the surrounding structure (e.g., welds 106) is shown. The tuning method 206 may be used to achieve the desired responses for the particular input load 200 imparted on the support member 94. It will be appreciated that while the tuning method 206 may be used to achieve the desired responses, other considerations, including non-performance related objectives such as packaging, cost, and manufacturability may be included with the tuning method 206.

The tuning method 206 begins in step 208. In step 208 parameters for the input load that will be applied to the support member 94 are determined. For example, the input load may be the load 200 imparted by the crankshaft 68 to the support member 94 as previously explained. The parameters for the input load 200 include the magnitude, direction, and cyclical nature of the load 200. The parameters may be determined using a variety of methods, including physical testing of the scroll machine 10 and analysis.

In step 210, parameters for a desired distribution of the load 200 to the structure supporting the support member 94 are determined based on the input load parameters determined in step 208. The foregoing parameters will be referred to as desired distributional parameters hereinafter. The desired distributional parameters may relate to the axial, lateral, and bending loads 202, 203, 204 that are transmitted to the welds 106. The desired distributional parameters may include the magnitude, direction, and cyclical nature of the axial, lateral, and bending loads 202, 203, 204.

The desired distributional parameters may be determined in a variety of ways. For example, the desired distributional parameters may be determined to distribute the load 200 within the support member 94 such that the axial loads 202 and lateral loads 203 transferred to the welds 106 are substantially equal. In this manner, the maximum axial loads 202 and lateral loads 203 transferred to the welds 106 may be lowered.

Alternatively, the desired distributional parameters may be chosen to distribute the load 200 in an asymmetrical manner such that the axial, lateral, and bending loads 202, 203, 204 transferred to the welds 106 are unequal. For example, it may be desired to distribute the load 200 in an asymmetrical manner that causes greater axial loading of the welds 106 than bending. An asymmetrical distribution of the lateral and torsional loads 202, 204 may be desired where the load 200 is a fluctuating load that is not constant with crank angle.

The desired distributional parameters may be determined to distribute the load 200 in a predetermined manner such that stresses of a particular magnitude and nature result among the welds 106. Stresses of a particular magnitude and nature may be desired to improve the fatigue life of the welds 106 and surrounding support structure. Thus, the desired distributional parameters may be determined based on features of the welds 106, including the fusion zones 196, 198.

The desired distributional parameters may be determined to distribute the load 200 in a manner that produces a particular vibration response of the supporting structure (e.g., hermetic shell 12). A particular vibration response of the supporting structure may be desired to reduce the noise generated by the load 200.

In step 212, parameters for a desired internal response of the support member 94 are determined based on the input load parameters determined in step 208 and the desired distributional parameters determined in step 210. The desired internal response parameters may include the magnitude of the maximum lateral and torsional loads induced in the support member 94. The desired internal response parameters may also include the maximum axial and bending stresses induced in the support member 94.

The desired internal response parameters may be determined in a variety of ways. For example, the desired internal response parameters may be determined to achieve balance among the axial and bending stresses that are induced in the inner spokes 114, rim 116, and outer spokes 118 by the load 200. Balancing the axial and bending stresses may be desired to lower the maximum stresses induced among the various elements of the support member 94 and achieve a desired vibration response of the support member 94. Balancing the axial and bending stresses may be desired to improve retention of the weld insert 188 (FIG. 2).

The desired internal response parameters may also be determined to achieve a predetermined deflection response of the hub 112 to the load 200. The deflection response of the support member 94 and hub 112 may be determined to provide a particular motor air gap 104 (FIG. 1).

The desired internal response parameters may be determined to achieve a predetermined vibration response of the hub 112 to the load 200. The vibration response of the support member 94 may be determined to attenuate the noise generated by the support member 94 and its response to the load 200.

Accordingly, in step 212, the desired internal response parameters may be determined using one or more of the foregoing methodologies.

In step 214, initial structural, relational, and dimensional features of the support member 94 are determined based on the parameters determined in steps 208-212. More specifically, initial structural features such as, but not limited to, the number of inner spokes 114, connecting portions 160, and outer spokes 118 are determined to achieve the desired external and internal response parameters determined in steps 210, 212 based on the parameters for the input load determined in step 208.

Similarly, dimensional features of the support member 94 such as, but not limited to, the length 150 and the cross-sectional area 152 of the inner spokes 114, the length 166 and the cross-sectional area 168 of the connecting portions 160 of the rim 116, and the length 178 and the cross-sectional area 180 of the body 170 of the outer spokes 118 are determined to achieve the desired external and internal response parameters.

Additionally, relational features of the support member 94 such as, but are not limited to, the angles 148 between the inner spokes 114, the included angles 174 between the outer spokes 118, the angle 176 between the inner and outer spokes 114, 118, and the vertical distance 186 of the distal end 182 above the center of the hub 112 are determined to achieve the desired external and internal response parameters.

Finite element models of the support member 94, the hermetic shell 12, and the welds 106 may be developed and used to determine the initial structural, dimensional, and relational features of the support member 94 to achieve the desired results.

In step 216, actual distributional and internal response parameters are determined using the initial structural, relational, and dimensional features of the support member 94 determined in step 214 and the parameters of the input load determined in step 208. The actual distributional and internal response parameters may be determined using any suitable method, including physical testing, finite element methods, or a combination thereof.

In step 218 the desired distributional and internal response parameters determined in steps 210, 212 are compared with the actual distributional and internal response parameters determined in step 216 in order to determine if any modification of the initial structural, relational, and dimensional features is desired. For example, the actual and desired magnitude, direction, and cyclical nature of the axial, lateral, and bending loads 202, 203, 204 distributed to the surrounding structure may be compared. Additionally, the actual vibration responses of the support member 94 and the hermetic shell 12 and the corresponding noise generated may be assessed.

Based on the foregoing comparisons, modification may be desired for one or more reasons. For example, where the desired distributional parameters were determined in step 210 to distribute the input load equally to the supporting structure, differences greater than ten percent between the actual and desired magnitude of the axial, lateral, and bending loads 202, 203, 204 may be deemed sufficient to modify the initial structural, relational, and dimensional features determined in step 214. Similarly, where the desired internal response parameters included maximum axial and bending stresses, actual axial and bending stresses greater than those desired may be sufficient cause for modification.

Additionally, modification may be desired to achieve other objectives. For example, modification may be desired to achieve objectives related to packaging, cost, and manufacturability. Modification of the structural, relational, and dimensional features may be desired to achieve these other objectives in addition to the desired responses.

From the foregoing, it will be appreciated that the decision whether to modify the features determined in step 214 may be based on one or more differences between the desired and actual distributional parameters and/or differences between the desired and actual internal response parameters. Additionally, the decision whether to modify the features may be based on additional non-performance related objectives. If modification is desired, steps 214 through 218 are repeated until the actual distributional and internal response parameters of the support member sufficiently meet the desired distributional and internal response parameters. If modification is not desired, then the tuning method 206 ends.

In the foregoing manner, the tuning method 206 may be used in an iterative manner to determine the particular structural, relational, and dimensional features to distribute the input load 200 throughout the support member 94 and to the welds 106 in a desired manner. It will be appreciated that the tuning method 206 is not limited to determining the features of the support member 94 previously described, but may be applied to other embodiments of the support member 94 according to the principles of the present disclosure.

With reference to FIGS. 8*a*-8*b*, a support member 94*a* is provided. In view of the substantial similarity in structure and function of the components associated with the support member 94 and support member 94*a*, like reference numerals are used hereinafter and in the drawings to identify like components while like reference numerals containing letter extensions are used to identify those components that have been modified.

Support member 94*a* is substantially similar to the support member 94, except that support member 94*a* includes inner spokes 114*a* that lie along an inclined axis and outer spokes 118*a*. Thus, the support member 94*a* includes the hub 112 and the rim 116, as previously described for the support member 94.

The inner spokes 114*a* include a body 140*a* that defines inner and outer ends 142*a*, 144*a*. The inner and outer ends 142*a*, 144*a* define an inclined axis 146*a* that forms an angle 220 with axis 130 of the hub 112 (FIG. 8*b*). The particular value chosen for the angle 220 may vary in order to raise or lower the outer spokes 118*a* a vertical distance with respect to the inner ends 142*a* of the inner spokes 114*a*. The outer spokes 118*a* are similar to the outer spokes 118, except that the outer spokes 118*a* do not include the fixturing legs 181 previously described. Included angles 148*a* between the inner spokes 114*a* and included angles 174*a* between the outer spokes 118*a* are substantially equal to ninety degrees. A rotational angle 176*a* between each of the outer spokes 118*a* and an adjacent one of the inner spokes 114*a* is substantially equal to forty-five degrees.

With reference to FIGS. 9*a*-9*b*, a support member 94*b* is provided. Support member 94*b* is substantially similar to the support member 94*a* (FIGS. 8*a*-8*b*), except that the outer spokes 118*a* are positioned at a different rotational angle with respect to the inner spokes 114*a*. Accordingly, the support member 94*b* includes hub 112, inner spokes 114*a*, and outer spokes 118*a*, as previously described. The support member 94*b* further includes a rim 116*b* that includes complementary connecting portions 160*b*.

The connecting portions 160*b* connect each one of the outer spokes 118*a* to adjacent inner spokes 114*a* such that the outer spokes 118*a* are positioned at a rotational angle 176*b* with respect to the inner spokes 114*a*. The angle 176*b* between the inner and outer spokes 114*a*, 118*a* may vary and may be zero degrees or more. For exemplary purposes, the angle 176*b*, as shown, is 22.5 degrees. The outer spokes 118*a* may be positioned closer to the inner spokes 114*a* where the loads imparted by the crankshaft 68 on the support member 94*b* are not constant with respect to crank angle.

With reference to FIGS. 10*a*-10*b*, a support member 94*c* is provided. Support member 94*c* is substantially similar to the support member 94*a* (FIGS. 8*a*-8*b*), except that support member 94*c* includes three inner and outer spokes instead of four. Fewer inner and outer spokes may be included for reasons related to the mass and manufacturability of the support member. Fewer inner and outer spokes may also be included to reduce the space required to package the support member 94*c* in the hermetic shell 12.

Support member 94*c* includes a hub 112*c*, three inner spokes 114*c*, a rim 116*c*, and three outer spokes 118*c*. The hub 112*c* includes a body 120*c* connected to inner ends 142*c* of the inner spokes 114*c*. Outer ends 144*c* of the inner spokes 114*c* are connected to the rim 116*c*. The inner and outer ends 142*c*, 144*c* define an inclined axis 146*c*. The rim 116*c* includes complementary connecting portions 160*c* for connecting each one of the outer spokes 118*c* to a corresponding two adjacent inner spokes 114*c*. The outer spokes 118*c* extend along an axis 172*c*.

The structural, dimensional, and relational parameters chosen for the support member 94*c* may vary according to the principles previously described. For exemplary purposes, both the inner spokes 114*c* and the outer spokes 118*c* are arranged about an axis 130*c* of the hub 112*c* in a symmetrical fashion. Thus, included angles 148*c* between the inner spokes 114*c* and included angles 174*c* between the outer spokes 118*c* may be equal to 120 degrees. Additionally, angles 176*c* between the inner and outer spokes 114*c*, 118*c* may be equal to 60 degrees.

With reference to FIGS. 11*a*-11*b*, a support member 94*d* is provided. Support member 94*d* is substantially similar to the support member 94*a* (FIGS. 8*a*-8*b*), except that support member 94*d* includes eight inner spokes arranged in four pairs around the hub. Additional inner spokes may be included for reasons that include improved load distribution and stress balancing. The additional inner spokes may be arranged in a variety of ways as will be described.

The support member 94*d* includes a hub 112*d* that includes a body 120*d* connected to inner ends 142*d* of inner spokes 114*d*. The inner spokes 114*d* include outer ends 144*d* connected to a rim 116*d*. The inner and outer ends 142*d*, 144*d* define axes 146*d* that are inclined with respect to an axis 130*d* of the hub 112*d*. The inner spokes 114*d* are arranged in pairs that have an acute included angle 230 equal to thirty degrees. The pairs of inner spokes 114*d* may be arranged about axis 130*d* in a generally symmetrical fashion. As such, angles 232 between the corresponding inner spokes 114*d* of adjacent pairs may be equal to 90 degrees as shown.

The rim 116*d* includes a plurality of complementary connecting portions 160*d*. The connecting portions 160*d* work together to connect the outer spokes 118*a* to the outer ends 144*d* of two corresponding adjacent inner spokes 114*d* at an included angle 234. The rim 116*d* further includes intermediate portions 236 disposed between the connecting portions 160*d*. The intermediate portions 236 define first and second ends 238, 240 that are connected to the outer ends 144*d* of the inner spokes 114*d*.

With reference to FIGS. 12*a*-12*b*, a support member 94*e* is provided. Support member 94*e* is substantially similar to the support member 94*a* (FIGS. 8*a*-8*b*), except that a center of the rim is located a distance away from the axis of the hub along axes of the outer spokes. The rim may be positioned in a non-concentric manner with respect to the hub where the loads imparted by the crankshaft 68 to the support member 94*e* are not constant with respect to crank angle.

The support member 94*e* includes inner spokes 114*e* connected to the hub 112 and a rim 116*e* that connects outer spokes 118*e* to the inner spokes 114*e*. The inner spokes 114*e* include inner and outer ends 142*e*, 144*e* that define an axis 146*e* that is inclined with respect to axis 130 of the hub 112. Included angles 148*e* between adjacent inner spokes 114*e* may be substantially equal to one another. Each of the inner spokes 114*e* has a length 150*e*. The rim 116*e* is generally ring-shaped and includes connecting portions 160*e* for connecting the outer spokes 118*e* to the inner spokes 114*e*. The rim 116*e* is centered a distance 250 away from axis 130 of the hub 112. The length 150*e* of each of the inner spokes 114*e* may be unequal in order to fix the position of the rim 116*e* in a desired location with respect to the hub 112.

The outer spokes 118*e* each has a body 170*e* that is connected to the rim 116*e* and extends radially from the rim 116*e* along an axis 172*e*. Included angles 174*e* between the body 170*e* of adjacent outer spokes 118*e*, as measured around axis 130 may be equal to about ninety degrees as shown. The body 170*e* of each of the outer spokes 118 may be positioned at a rotational angle 176*e* with respect to a corresponding one of the inner spokes 114*e*. The body 170*e* includes a distal end 182*e* that is located a length 178*e* away from the rim 116*e* and attached to the hermetic shell 12. The distance 178*e* each of the outer spokes 118*e* extends may be unequal. The inner spokes 114*e*, rim 116*e*, and outer spokes 118*e* work together to position the hub 112 at a desired position (e.g., center) of the hermetic shell 12.

With reference to FIGS. 13*a*-13*b*, a support member 94*f* is provided. Support member 94*f* is substantially similar to the support member 94*a* (FIGS. 8*a*-8*b*), except that the rim is generally square in shape and thus includes straight, rather than curved, connecting portions. A square rim may be included for reasons related to the mass and manufacturability of the support member 94*f*, as well as the packaging of the support member 94*f* in the hermetic shell 12.

The support member 94*f* includes the hub 112, inner spokes 114*a*, and outer spokes 118*a*, as previously described. The support member 94*f* further includes a rim 116*f* that includes connecting portions 160*f* for connecting the outer spokes 118*a* to the inner spokes 114*a*. The connecting portions 160*f* include first and second ends 162*f*, 164*f* that connect the outer spokes 118*a* to corresponding adjacent inner spokes 114*a*. Each of the connecting portions 160*f* are generally straight, elongate members. The second ends 164*f* may be connected together to give the rim 116*f* a generally square shape (FIG. 13*a*).

With reference to FIGS. 14*a*-14*b*, a support member 94*g* is provided. Support member 94*g* is substantially similar to the support member 94*a* (FIGS. 8*a*-8*b*), except that the rim includes connecting portions that curve inward towards the hub, rather than outward away from the hub. Connecting portions that curve inward may be included for reasons related to the mass of the support member 94*g*, as well as the packaging of the support member 94*g* in the hermetic shell 12.

The support member 94*g* includes the hub 112, inner spokes 114*a*, and outer spokes 118*a*, as previously described. The support member 94*g* further includes a rim 116*g* that includes connecting portions 160*g* for connecting the outer spokes 118*a* to the inner spokes 114*a*. The connecting portions 160*g* include first and second ends 162*g*, 164*g* that connect the outer spokes 118*a* to corresponding adjacent inner spokes 114*a*. Each of the connecting portions 160*f* are generally curved, elongate members. The second ends 164*g* may be connected together as shown to give the rim 116*g* the four-sided shape shown in FIGS. 14*a*-14*b*.

With reference to FIGS. 15*a*-15*b*, a support member 94*h* is provided. Support member 94*h* is substantially similar to the support member 94*a* (FIGS. 8*a*-8*b*), except that the rim is discontinuous. A discontinuous rim may be included for reasons related to the mass and vibration response of the support member 94*h*. A discontinuous rim may also be included for reasons related to the packaging of the support member 94*h* in the hermetic shell 12.

The support member 94*h* includes the hub 112, inner spokes 114*a*, and outer spokes 118*a*, as previously described. The support member 94*h* further includes connecting portions 160*h* having first and second ends 162*h*, 164*h* for connecting the outer spokes 118*a* to the inner spokes 114*a*. Each of the outer spokes 118*a* is connected to one of the inner spokes 114*a* by a corresponding one of the connecting portions 160*h*.

With reference to FIGS. 16*a*-16*b*, a support member 94*i* is provided. Support member 94*i* is substantially similar to the support member 94*a* (FIGS. 8*a*-8*b*), except that the rim is discontinuous and includes ring-shaped connecting portions. Ring-shaped connecting portions may be included for reasons that include tuning the vibration response of the support member 94*i*.

The support member 94*i* includes the hub 112, inner spokes 114*a*, and outer spokes 118*a*, as previously described. The support member 94*i* further includes connecting portions 160*i* that are generally ring-shaped and extend substantially perpendicular to the inner spokes 114*a*. Each of the connecting portions 160*i* defines inner and outer walls 270, 272. The inner wall 270 defines a cavity 274 that is disposed between first and second ends 162*i*, 164*i* that connect to the outer spokes 118*a* and the inner spokes 114*a*, respectively.

The outer spokes 118*a* may connect to the connecting portions 160*i* such that axis 172*a* of the outer spokes 118*a* intersects with axis 146*a* of the inner spokes 114*a* (FIG. 16*a*). Thus, the outer spokes 118*a* may be positioned at a rotational angle 176*i* with respect to the inner spokes 114*a* that is substantially equal to zero degrees. Alternatively, the outer spokes 118*a* may be connected to the first ends 162*i* along the outer walls 272 such that the rotational angle 176*i* is greater than zero degrees.

With reference to FIGS. 17*a*-17*c*, a support member 94*j* is provided. The support member 94*j* includes the hub 112 and outer spokes 118*a*, as previously described. The support member 94*j* further includes inner spokes 114*j* and a rim 116*j* having planar connecting portions 160*j* that connect the outer spokes 118*a* to the inner spokes 114*j*. The inner spokes 114*j* include first and second beams 280, 282 that intersect in a generally orthogonal manner to define a cross-sectional area 180*j*.

The first and second beams 280, 282 may be positioned in a substantially vertical and horizontal orientation (FIG. 17*c*). The beams 280, 282 intersect along an axis 284 that may be inclined such that axis 284 forms an included angle 286 with axis 130 of the hub 112. Dimensional parameters may be chosen for the first and second beams 280, 282 to provide the inner spokes 114*j* with a particular vertical and horizontal bending stiffness, while minimizing the mass of the inner spokes. The first and second beams 280, 282 work together with the connecting portions 160*j* and may be tuned to provide a desired load distribution and vibration response of the support member 94*j*.

The outer spokes 118*a* may connect to the connecting portions 160*j* such that axis 172*a* of the outer spokes 118*a* intersects with axis 284 of the inner spokes 114*a* (FIG. 17*a*). Thus, the outer spokes 118*a* may be positioned at a rotational angle 176*j* with respect to the inner spokes 114*j* that is substantially equal to zero degrees. Alternatively, the outer spokes 118*a* may be connected to the connecting portions 160*j* such that the rotational angle 176*j* is greater than zero degrees.

With reference to FIG. 18, a support member 94*k* is provided. Support member 94*k* is substantially similar to the support member 94*a* (FIGS. 8*a*-8*b*), except that the axes of the inner spokes are offset from the axis of the hub. The support member 94*k* includes the hub 112, rim 116, and outer spokes 118*a*, as previously described. The support member 94*k* further includes inner spokes 114*k*. The inner spokes 114*k* define inner and outer ends 142*k*, 144*k* that connect to the hub 112 and the rim 116, respectively. An axis 146*k* extends between the inner and outer ends 142*k*, 144*k*. Axis 146*k* is offset from axis 130 of the hub 112 by a distance 290. The inner spokes 114*k* may be positioned at a rotational angle 176*k* with respect to axis 172*a* of a corresponding one of the outer spokes 118*a*.

With reference to FIG. 19, a support member 94*m* is provided. The support member 94*m* is substantially similar to the support member 94*a* (FIGS. 8*a*-8*b*), except that the inner spokes include curved, elongate portions. The support member 94*m* includes the hub 112, rim 116, and outer spokes 118*a*, as previously described. The support member 94*m* further includes inner spokes 114*m*. The inner spokes 114*m* each include a body 140*m* that defines inner and outer ends 142*m*, 144*m* that define an axis 146*m* and connect the inner spokes 114*m* to the hub 112 and the rim 116, respectively. The inner spokes 114*m* may be positioned at a rotational angle 176*m* with respect to axis 172*a* of a corresponding one of the outer spokes 118*a*. The body 140*m* may include one or more straight portions 292 and one or more curved portions 294. For example, the inner spokes 114*m* may include a single curved portion 294 disposed between two straight portions 292 (FIG. 19). The body 140*m* may have a cross-sectional area substantially similar to the cross-sectional area 180 previously described.

With reference to FIGS. 20*a*-*b*, a support member 94*n* is provided. The support member 94*n* is substantially similar to the support member 94, except that the rotational angle 176*n* between the axis 146 of the inner spokes 114 and an axis 172*n* of outer spokes 118*n* is zero. Additionally, the outer spokes 118*n*, while generally cylindrical, do not have the fixturing legs 181 of the outer spokes 118 (FIG. 5).

The support member 94*n* includes the hub 112 and inner spokes 114, as previously described for the support member 94. A rim 116*n* connects the inner spokes 114 and the outer spokes 118*n*. The rim 116*n* includes connecting portions 160*n* that connect the inner and outer spokes 114, 118*n* such that the angle 176*n* is zero. The connecting portions 160*n* may interconnect as shown and thereby form a continuous ring. The connecting portions 160*n*, while connecting at least two inner spokes 114, may be spaced apart and separated from the shell 12 of the compressor 10 and may include a shape that mimics the shape of the shell 12.

As shown in FIG. 20*b*, the axis 172*n* of each of the outer spokes 118*n* may be parallel to and offset from the plane defined by the axes of the inner spokes 114 by a distance 186*n*. While the axis 172*n* of each of the outer spokes 118*n* may be parallel to the plane defined by the inner spokes 114, the axis 172*n* of one or more of the outer spokes 118*n* may be oblique to the plane.

Those skilled in the art can now appreciate from the foregoing discussion that the broad teachings of the present disclosure can be implemented in a variety of forms. It should be appreciated that the foregoing description of the present teachings is merely exemplary in nature and, thus, variations that do not depart from the gist of the teachings are intended to be within the scope of the teachings. Such variations are not to be regarded as a departure from the spirit and scope of the teachings.

What is claimed is:

1. A support member for a compressor including a shell having an inner surface, the support member comprising:

a hub for receiving a load from the compressor;

at least three spokes radially extending from said hub;

at least three attachment locations for attaching said at least three spokes to the shell; and a connecting portion extending between said at least three spokes to transmit a load between said at least three spokes, said connecting portion being spaced apart and separated from the shell around an entire perimeter of said connecting portion and including a continuous ring shape.

2. The support member of claim 1, wherein said hub includes a longitudinal axis extending therethrough.

3. The support member of claim 2, wherein each of said at least three spokes are disposed in a plane that is substantially perpendicular to said longitudinal axis of said hub.

4. The support member of claim 3, wherein said plane extends through an entire length of said at least three spokes.

5. The support member of claim 2, wherein said at least three spokes are formed at an angle relative to a hypothetical plane extending through at least a portion of said at least three spokes and substantially perpendicular to said longitudinal axis of said hub.

6. The support member of claim 2, wherein said connecting portion is disposed in a plane that is substantially perpendicular to said longitudinal axis of said hub.

7. The support member of claim 1, wherein each of said at least three spokes includes a longitudinal axis extending along its length, and wherein at least one of said longitudinal axes passes through one of said at least three attachment locations.

8. The support member of claim 7, wherein at least one of said longitudinal axes passes through one of said at least three attachment locations, and wherein each one of said longitudinal axes is spaced apart from each one of said at least three attachment locations.

9. The support member of claim 1, wherein said at least three spokes includes four spokes radially extending from said hub and said at least three attachment locations includes four attachment locations attaching said four spokes to the shell.

10. The support member of claim 1, wherein said ring includes a central axis that is coaxial with a rotational axis of a drive member extending through said hub.

11. The support member of claim 9, wherein said connecting portion and said four spokes are disposed in the same plane.

12. A compressor comprising:

a shell having an inner surface;

a compression mechanism disposed within said shell;

a drive member disposed within said shell for driving said compression mechanism; and a support member including a hub rotatably supporting said drive member, at least three spokes radially extending from said hub, at least three attachment locations attaching said at least three spokes to said shell, and connecting portions respectively extending between adjacent ones of said at least three spokes to transmit a load between said spokes, said connecting portions each including an outer perimeter surface that is spaced apart from and opposes said inner surface along an entire length of said connecting portions, said connecting portions cooperating with one another to provide said support member with a continuous circular shape at said connecting portions.

13. The compressor of claim 12, wherein said hub includes a longitudinal axis extending therethrough, said longitudinal axis being substantially parallel to a longitudinal axis of said drive member.

14. The compressor of claim 13, wherein each of said at least three spokes are disposed in a plane that is substantially perpendicular to said longitudinal axis of said hub.

15. The compressor of claim 14, wherein said plane extends through an entire length of said at least three inner spokes.

16. The compressor of claim 13, wherein said at least three spokes are formed at an angle relative to a hypothetical plane extending through at least a portion of said at least three spokes and substantially perpendicular to said longitudinal axis of said hub.

17. The compressor of claim 13, wherein said connecting portions are disposed in a plane that is substantially perpendicular to said longitudinal axis of said hub.

18. The compressor of claim 12 wherein said at least three spokes includes four spokes radially extending from said hub and said at least three attachment locations includes four attachment locations attaching said four spokes to said shell.

19. The compressor of claim 18, wherein said connecting portions and said four spokes are disposed in the same plane and cooperate to form a ring encircling said hub.

20. The compressor of claim 19, wherein said ring includes a central axis that is coaxial with a rotational axis of said drive member.

21. The compressor of claim 18, wherein each of said four spokes includes a longitudinal axis extending along its length, and wherein each one of said longitudinal axes passes through a respective one of said four attachment locations.

22. The compressor of claim 21, wherein each one of said longitudinal axes passes through a respective one of said four attachment locations, and wherein each one of said longitudinal axes is spaced apart from each one of said four attachment locations.

* * * * *

UNITED STATES PATENT AND TRADEMARK OFFICE

CERTIFICATE OF CORRECTION

PATENT NO. : 8,342,795 B2
APPLICATION NO. : 12/428751
DATED : January 1, 2013
INVENTOR(S) : Thomas R. Hodapp It is certified that error appears in the above-identified patent and that said Letters Patent is hereby corrected as shown below:

In the Drawings

| | |
|---|---|
| Sheet 9 of 18, Reference Numeral 112, Fig. 10a | Delete “112” and insert --112c--. |
| Sheet 9 of 18, Reference Numeral 112, Fig. 10b | Delete “112” and insert --112c--. |
| Sheet 18 of 18, Reference Numeral 44n, Fig. 20a | Delete “44n” and insert --94n--. |
| Sheet 18 of 18, Reference Numeral 94, Fig. 20b | Delete “94” and insert --94n--. |

In the Specifications

| | |
|---|---|
| Column 3, Line 60 | Delete “it” and insert --is--. |
| Column 3, Line 65 | After “is”, insert --a--. |
| Column 4, Line 1 | After “is”, insert --a--. |
| Column 4, Line 4 | After “is”, insert --a--. |
| Column 4, Line 7 | After “is”, insert --a--. |
| Column 4, Line 10 | After “is”, insert --a--. |
| Column 4, Line 13 | After “is”, insert --a--. |
| Column 4, Line 16 | After “is”, insert --a--. |
| Column 4, Line 19 | After “is”, insert --a--. |
| Column 4, Line 22 | After “is”, insert --a--. |
| Column 4, Line 25 | After “is”, insert --a--. |
| Column 6, Line 20 | Delete “part” and insert --apart--. |
| Column 15, Line 43 | Delete “118” and insert --118e--. |
| Column 17, Line 32 | Delete “116” and insert --116a--. |
| Column 17, Line 46 | Delete “116” and insert --116a--. |

In the Claims

| | |
|---|---|
| Column 20, Line 1 | In Claim 18, Delete “12” and insert --12,--. |

Signed and Sealed this
Twenty-ninth Day of April, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,342,795 B2
APPLICATION NO. : 12/428751
DATED : January 1, 2013
INVENTOR(S) : Thomas R. Hodapp It is certified that error appears in the above-identified patent and that said Letters Patent is hereby corrected as shown below:

In the Drawings

| | |
|---|---|
| Sheet 9 of 18, Reference Numeral 112, Fig. 10a | Delete “112” and insert --112c--. |
| Sheet 9 of 18, Reference Numeral 112, Fig. 10b | Delete “112” and insert --112c--. |
| Sheet 18 of 18, Reference Numeral 44n, Fig. 20a | Delete “44n” and insert --94n--. |
| Sheet 18 of 18, Reference Numeral 94, Fig. 20b | Delete “94” and insert --94n--. |

In the Specifications

| | |
|---|---|
| Column 3, Line 60 | Delete “it” and insert --is--. |
| Column 3, Line 65 | After “is”, insert --a--. |
| Column 4, Line 1 | After “is”, insert --a--. |
| Column 4, Line 4 | After “is”, insert --a--. |
| Column 4, Line 7 | After “is”, insert --a--. |
| Column 4, Line 10 | After “is”, insert --a--. |
| Column 4, Line 13 | After “is”, insert --a--. |
| Column 4, Line 16 | After “is”, insert --a--. |
| Column 4, Line 19 | After “is”, insert --a--. |
| Column 4, Line 22 | After “is”, insert --a--. |
| Column 4, Line 25 | After “is”, insert --a--. |
| Column 6, Line 20 | Delete “part” and insert --apart--. |
| Column 15, Line 43 | Delete “118” and insert --118e--. |
| Column 17, Line 32 | Delete “116” and insert --116a--. |
| Column 17, Line 46 | Delete “116” and insert --116a--. |

In the Claims

| | |
|---|---|
| Column 20, Line 12 | In Claim 18, Delete “12” and insert --12,--. |

This certificate supersedes the Certificate of Correction issued April 29, 2014.

Signed and Sealed this
Twentieth Day of May, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,342,795 B2
APPLICATION NO. : 12/428751
DATED : January 1, 2013
INVENTOR(S) : Hodapp It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 629 days.

Signed and Sealed this
Eighteenth Day of November, 2014

Michelle K. Lee

Michelle K. Lee
*Deputy Director of the United States Patent and Trademark Office*